US009079067B2

(12) United States Patent
Huber et al.

(10) Patent No.: US 9,079,067 B2
(45) Date of Patent: Jul. 14, 2015

(54) EXERCISE MACHINE WITH STATIONARY BICYCLE AND INFLATABLE SEAT

(75) Inventors: Aaron D. Huber, Louisville, OH (US); Richard A. Huber, Washingtonville, OH (US)

(73) Assignee: Cordio, LLC, Akron, OH (US)

( * ) Notice: Subject to any disclaimer, the term of this patent is extended or adjusted under 35 U.S.C. 154(b) by 77 days.

(21) Appl. No.: 13/132,178

(22) PCT Filed: Mar. 17, 2010

(86) PCT No.: PCT/US2010/000797

§ 371 (c)(1), (2), (4) Date: Jun. 1, 2011

(87) PCT Pub. No.: WO2010/134944

PCT Pub. Date: Nov. 25, 2010

(65) Prior Publication Data

US 2011/0237403 A1 Sep. 29, 2011

Related U.S. Application Data

(60) Provisional application No. 61/216,599, filed on May 18, 2009.

(51) Int. Cl.

| | |
|---|---|
| ***A63B 22/06*** | (2006.01) |
| ***A63B 69/16*** | (2006.01) |
| ***A63B 41/00*** | (2006.01) |
| ***A63B 71/06*** | (2006.01) |

(Continued)

(52) U.S. Cl.

CPC ..... *A63B 22/0605* (2013.01); *A63B 41/00* (2013.01); *A63B 71/0622* (2013.01); *A63B 21/0051* (2013.01); *A63B 21/0088* (2013.01); *A63B 21/015* (2013.01); *A63B 21/225* (2013.01); *A63B 23/0216* (2013.01); *A63B 2022/0652* (2013.01); *A63B 2208/0238* (2013.01); *A63B 2220/34* (2013.01); *A63B 2225/093* (2013.01); *A63B 2225/62* (2013.01); *A63B 2230/06* (2013.01); *A63B 2230/50* (2013.01); *A63B 2230/75* (2013.01)

(58) Field of Classification Search

USPC ..... 482/51, 57–66, 70, 77, 142, 148, 92, 482/121, 129, 130, 140, 52; 297/452.1, 297/452.41; D21/666, 667; D6/352

See application file for complete search history.

(56) References Cited

U.S. PATENT DOCUMENTS

| | | | |
|---|---|---|---|
| 4,126,326 | A | 11/1978 | Phillips |
| D330,237 | S | 10/1992 | Miller |

(Continued)

FOREIGN PATENT DOCUMENTS

| | | |
|---|---|---|
| FR | 2828640 | 2/2003 |
| GB | 2226769 | 7/1990 |
| WO | 9901332 | 1/1999 |

*Primary Examiner* — Loan H Thanh
*Assistant Examiner* — Nyca T Nguyen
(74) *Attorney, Agent, or Firm* — Sand & Sebolt

(57) ABSTRACT

An exercise machine includes a frame with foot pedals mounted thereon and a seat having an inflatable bladder whereby the user may undertake a cardiovascular workout and a core workout of abdominal and back muscles. A sensor may be used to sense the degree of compression of the inflatable bladder when a person sits on the inflatable seat whereby the internal pressure of the bladder may be adjusted accordingly. The frame may have two sections which are detachable so that one of the sections and the inflatable seat serve as a seating assembly when detached.

27 Claims, 12 Drawing Sheets

(51) Int. Cl.

| | |
|---|---|
| *A63B 21/005* | (2006.01) |
| *A63B 21/008* | (2006.01) |
| *A63B 21/015* | (2006.01) |
| *A63B 21/22* | (2006.01) |
| *A63B 23/02* | (2006.01) |

(56) References Cited

U.S. PATENT DOCUMENTS

| | | | | |
|---|---|---|---|---|
| 5,169,112 | A | 12/1992 | Boyles | |
| D355,942 | S | 2/1995 | Wu | |
| D362,699 | S | 9/1995 | Heaton et al. | |
| 5,690,389 | A * | 11/1997 | Ekman et al. | 297/452.41 |
| 5,833,587 | A | 11/1998 | Strong et al. | |
| D403,034 | S | 12/1998 | Moon et al. | |
| D410,712 | S | 6/1999 | Giger et al. | |
| D418,893 | S | 1/2000 | Peng | |
| 6,070,943 | A | 6/2000 | Guery-Strahm | |
| 6,171,217 | B1 | 1/2001 | Cutler | |
| 6,375,601 | B1 | 4/2002 | Johnson | |
| 6,447,070 | B1 | 9/2002 | Ekman et al. | |
| 6,461,284 | B1 * | 10/2002 | Francavilla | 482/142 |
| 6,478,721 | B1 * | 11/2002 | Hunter | 482/140 |
| 6,520,578 | B1 | 2/2003 | Jospa et al. | |
| D471,025 | S | 3/2003 | Chiu | |
| D471,371 | S | 3/2003 | Chiu | |
| 6,547,706 | B1 | 4/2003 | Chek | |
| D476,705 | S | 7/2003 | Dillard | |
| 6,616,238 | B1 * | 9/2003 | Guery-Strahm | 297/452.41 |
| 6,689,026 | B2 | 2/2004 | Almada | |
| 6,746,372 | B2 | 6/2004 | Hsu | |
| 6,827,402 | B2 | 12/2004 | Habermann et al. | |
| 6,832,817 | B1 | 12/2004 | Chiu | |
| D503,553 | S | 4/2005 | Chiu | |
| D503,756 | S | 4/2005 | Chiang | |
| D509,548 | S | 9/2005 | Heitzman et al. | |
| D513,421 | S | 1/2006 | Nagano | |
| D521,084 | S | 5/2006 | Huang | |
| 7,044,558 | B2 | 5/2006 | Chiu | |
| 7,060,015 | B2 | 6/2006 | Acher | |
| D528,172 | S | 9/2006 | Bingham, Jr. et al. | |
| 7,118,517 | B1 | 10/2006 | Hale | |
| 7,141,011 | B2 | 11/2006 | Williams et al. | |
| D536,542 | S | 2/2007 | Chiu | |
| D552,696 | S | 10/2007 | Hallar | |
| 7,341,548 | B2 | 3/2008 | Heitzman et al. | |
| 7,344,487 | B2 | 3/2008 | Carter et al. | |
| D610,635 | S | 2/2010 | Hildebrandt et al. | |
| 7,662,070 | B1 * | 2/2010 | Mann | 482/57 |
| 7,674,216 | B1 | 3/2010 | Bolling | |
| 7,713,180 | B2 | 5/2010 | Wickens et al. | |
| 2003/0199363 | A1 * | 10/2003 | Chen | 482/4 |
| 2005/0079964 | A1 * | 4/2005 | Francavilla | 482/142 |
| 2005/0107229 | A1 | 5/2005 | Wickens | |
| 2005/0261114 | A1 * | 11/2005 | Heitzman et al. | 482/142 |
| 2006/0040808 | A1 | 2/2006 | Riazi | |
| 2006/0063653 | A1 | 3/2006 | Wickens et al. | |
| 2007/0117682 | A1 | 5/2007 | Deola | |
| 2009/0098520 | A1 | 4/2009 | Wilson | |
| 2009/0111656 | A1 * | 4/2009 | Sullivan et al. | 482/4 |
| 2009/0325770 | A1 | 12/2009 | Baschnagel | |

* cited by examiner

EXERCISE MACHINE WITH STATIONARY BICYCLE AND INFLATABLE SEAT

CROSS REFERENCE TO RELATED APPLICATIONS

This application is a 371 National Phase of PCT Application Ser. No. PCT/US2010/000797, filed Mar. 17, 2010, which claims priority to U.S. Provisional Patent Application Ser. No. 61/216,599, filed May 18, 2009; the disclosures of which are incorporated herein by reference.

BACKGROUND OF THE INVENTION

1. Technical Field

The present invention relates generally to exercise machines. More particularly, the exercise machine includes or is in the form of a stationary bicycle which uses an inflatable seat to provide exercise of the core muscles of a person's trunk in combination with the cardiovascular exercise achieved primarily by pedaling the bicycle.

2. Background Information

Stationary bicycles are well known in the field of exercise machines. The primary focus of stationary bicycles is the exercise of the legs to provide a cardiovascular workout. However, the stationary bicycle does relatively little to provide a workout of the core muscles or trunk muscles of a person's stomach region and back region. Thus, it would be useful in the art to provide a stationary bicycle which does provide such a workout, especially for people who are interested in undertaking a more advanced exercise. The present invention primarily addresses this concern.

BRIEF SUMMARY OF THE INVENTION

The present invention includes in one aspect an exercise machine comprising foot pedals and a seat having an inflatable bladder whereby the user may undertake a cardiovascular workout and a core workout of abdominal and back muscles.

The present invention includes in another aspect an exercise machine comprising a seat having an inflatable bladder and a sensor which senses the degree of compression of the inflatable bladder whereby the internal pressure of the bladder may be adjusted.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
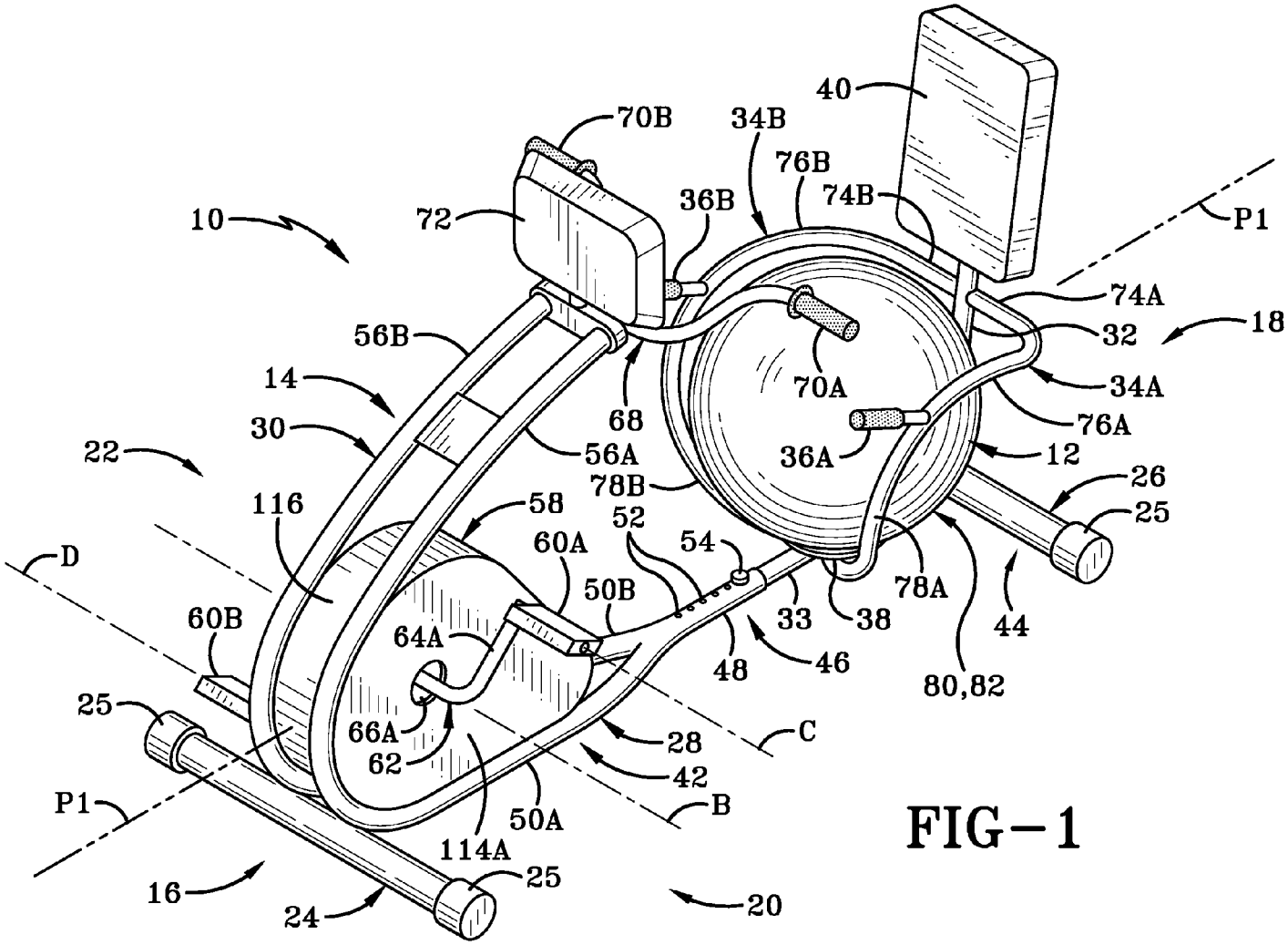
FIG. 1 is a perspective view of a first embodiment of the stationary bicycle of the present invention.
Figure 2:
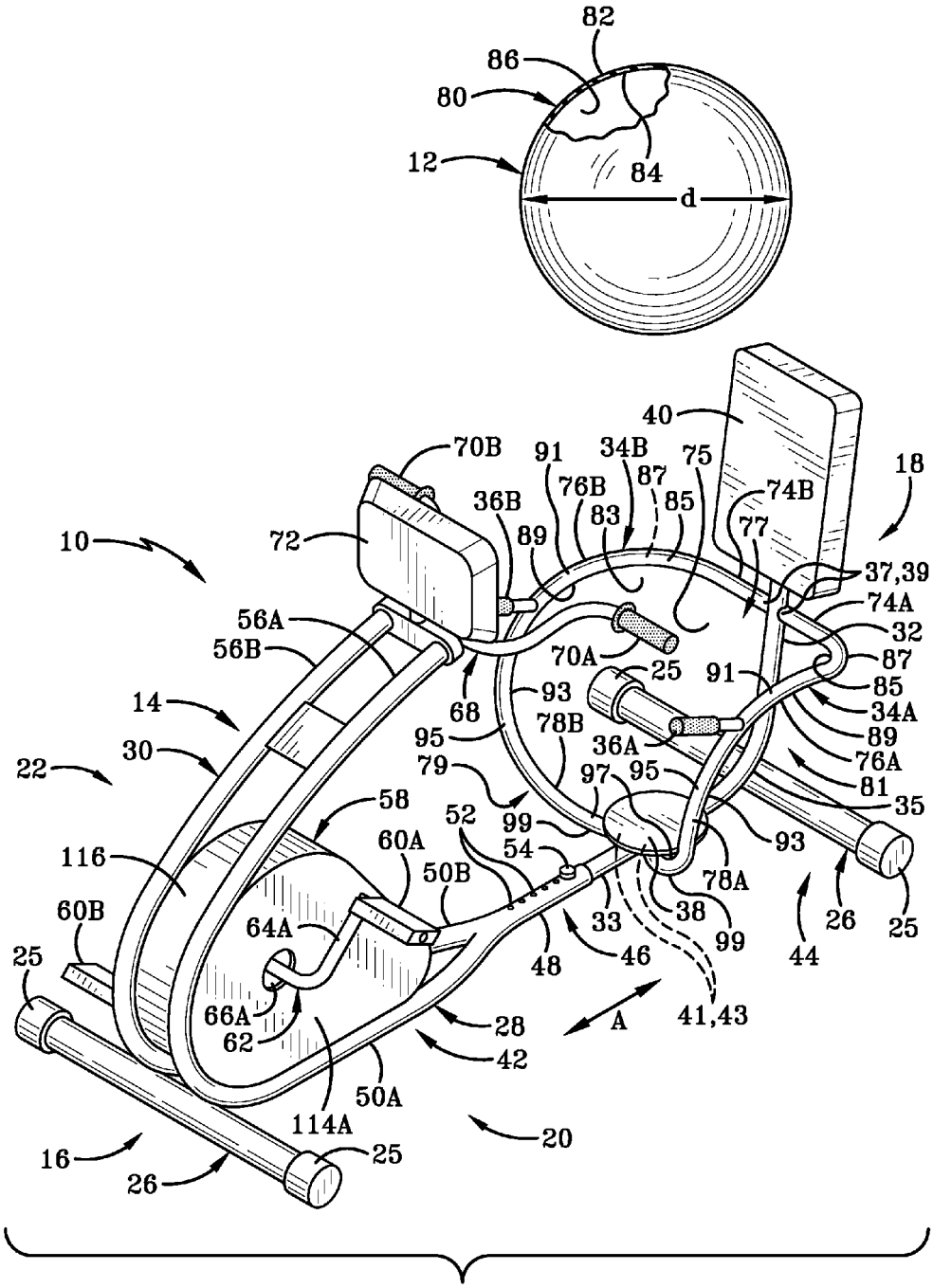
FIG. 2 is similar to FIG. 1 and shows the inflatable seat removed from the frame with portions cut away and shown in section.
Figure 3:
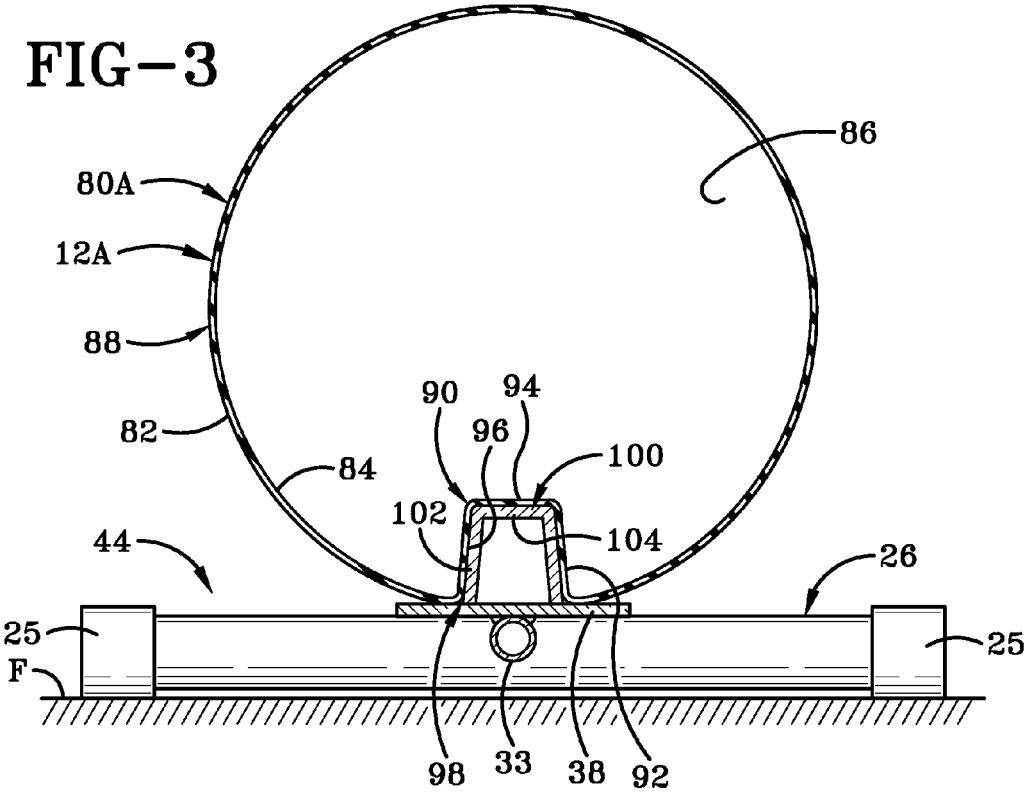
FIG. 3 is a sectional view of a modified inflatable seat and a modified mounting structure for mounting the seat thereon.
Figure 4:
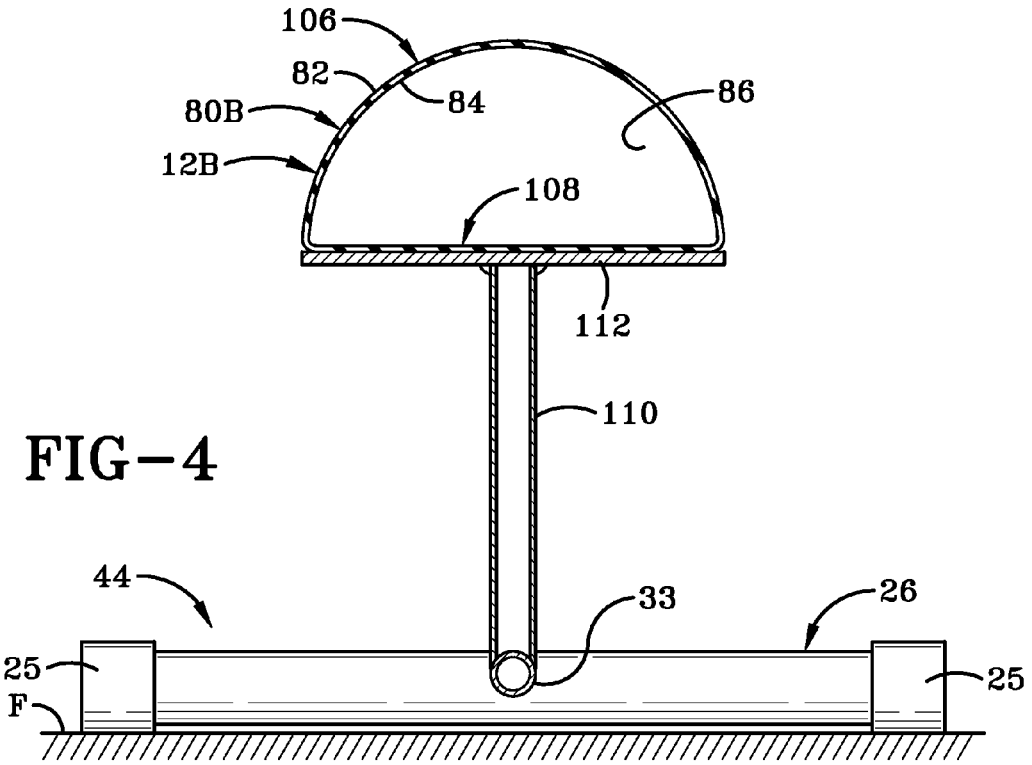
FIG. 4 is a sectional view similar to FIG. 3 showing another modified inflatable seat and associated modified mounting structure for the seat.

A first embodiment of the stationary exercise bicycle or bike of the present invention is shown generally at 10 in FIGS. 1 and 2; and a second embodiment of the stationary exercise bicycle of the present invention is shown generally at 100 in FIGS. 7-12. In accordance with the invention, bike 10 includes an inflatable seat 12. Although seat 12 has a spherical shape, it may be configured in a variety of shapes. FIG. 3 shows an alternate inflatable seat 12A which is substantially spherical and FIG. 4 shows inflatable seat 12B which is substantially hemispherical. Bike 10 includes a rigid frame 14 typically made of a metal such as steel or the like. Frame 14 has a front 16 and a back 18 defining therebetween a longitudinal direction of the frame and bike. Frame 14 has left and right sides 20 and 22 defining therebetween an axial direction of the frame and the bike. In the exemplary embodiment, frame 14 is configured as a free standing frame which is typically seated on a floor F (FIGS. 3-6) although it may be secured otherwise.

Frame 14 includes a rigid tubular axially elongated front floor or stability bar 24 and a rigid tubular axially elongated rear floor or stability bar 26 which is substantially parallel to bar 24. Each of bars 24 and 26 is typically straight and horizontal and has left and right end caps 25 mounted thereon which are seated on floor F and typically formed of a material which resists sliding along the floor and is sufficiently soft to minimize or eliminate scratching the floor. Frame 14 further includes a bottom longitudinal frame member 28 which is longitudinally elongated and extends horizontally between and is rigidly secured to bars 24 and 26. Each of bars 24 and 26 have respective left and right segments which extend axially outwardly in opposite directions from their connection with frame member 28. Bars 24 and 26 thus provide suitable stability to bike 10 when seated on the floor. Bars 24 and 26 and frame 28 are adjacent floor F when exercise machine 10 is seated thereon.

Frame 14 further includes a rigid front elevated support 30 which is rigidly secured to and extends upwardly from the front of frame member 28 and then rearwardly to a rear end which supports various components as noted further below. Frame 14 also includes a rigid tubular rear seat back support 32 which is in the form of an upright which is rigidly secured to the rear end of frame member 28 and extends upwardly from the rear member 28 and a rigid connection with rear bar 26. Longitudinal frame member 28 includes a rigid tubular straight rear longitudinal frame member 33 which is substantially horizontal and forms an L-shaped configuration in combination with support 32 via an arcuate tubular segment 35. Frame 14 further includes rigid tubular left and right arms 34A and 34B which are secured to upright support 32 and extend respectively axially outwardly therefrom, and forward and downwardly to frame member 33. In the exemplary embodiment, left and right arms 34A and 34B are mirror images of one another and thus are bilaterally symmetrical about a vertical central longitudinally extending plane P1 passing through the center of exercise machine 10 midway between left and right sides 20 and 22.

Figure 5:
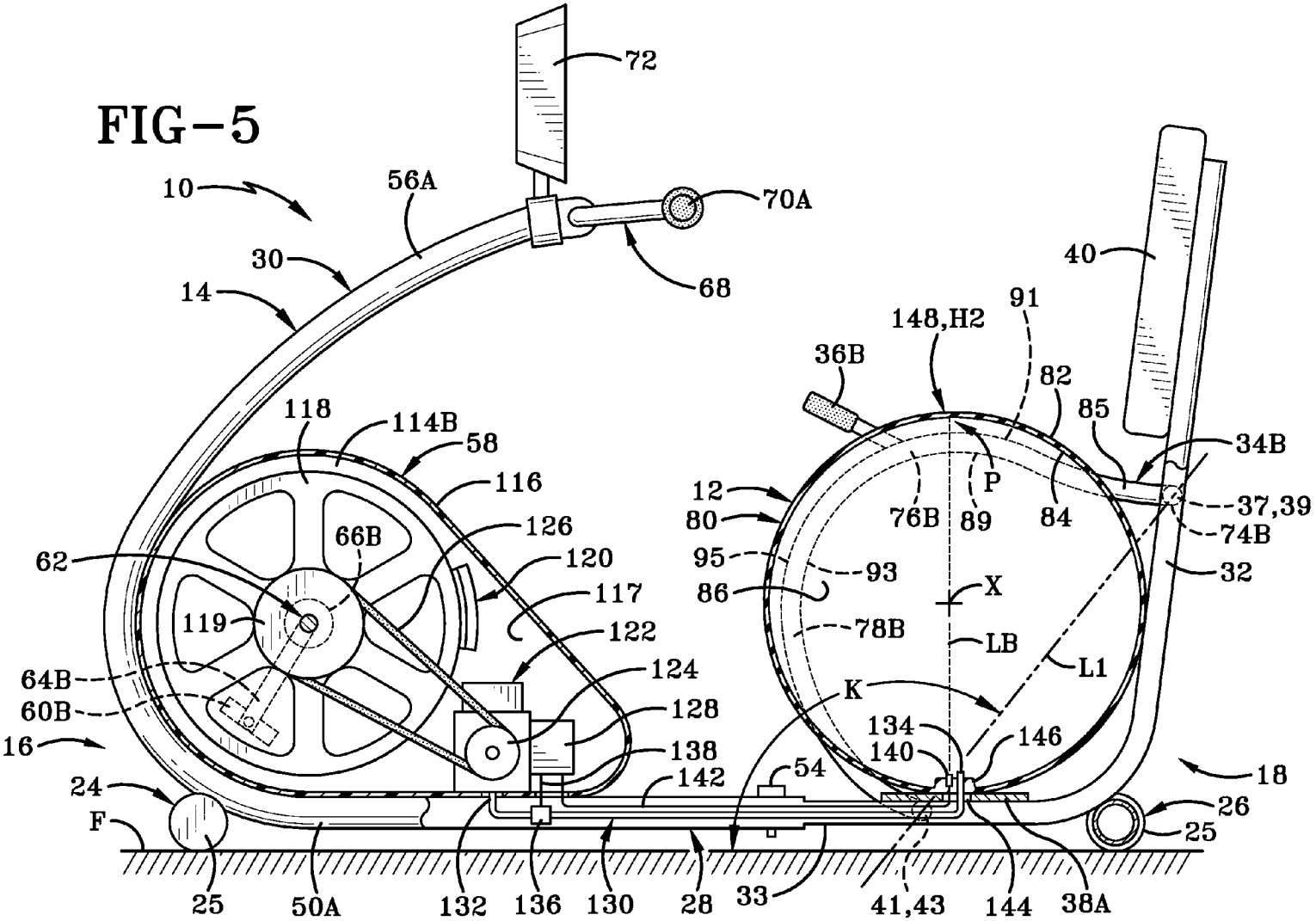
FIG. 5 is a side elevational view of the stationary bicycle with portions cut away and portions in section to show a pneumatic system and seat height sensor with the inflatable seat in the decompressed resting position.

Each arm 34 in the exemplary embodiment is formed of a single tube which thus extends from a first or rear end 37 attached at a rigid connection 39 to support 32 to a second or forward end 41 attached at a rigid connection 43 to frame member 33. Rear end 37 and connection 39 are rearward and higher than forward end 41 and connection 43. FIG. 5 illustrates a line L1 extending through the respective centers of ends 37 and 39 or connections 39 and 43 whereby line L1 and a horizontal plane such as floor F define therebetween an obtuse angle K which illustrates in part that line L1 angles upwardly and rearwardly. In the exemplary embodiment, angle K is typically in the range of about 120, 125 or 130 degrees to about 140, 145 or 150 degrees although this may vary. Left and right rigid side-grip handles 36A and 36B are respectively secured to left and right arms 34A and 34B and project outwardly therefrom in cantilever fashion. Handles 36 typically include grips formed of a resilient compressible material such as a foam, rubber or elastomer. These grips of the handles may have built-in heart rate or pulse sensors.

Frame 14 further includes a rigid ball support in the form of a flat circular plate or disc 38 which is substantially horizontal and secured to the top of frame member 33 adjacent the intersection with arms 34. Ball 12 is seated atop plate 38 and adjacent the back or rear end 18 of the frame. Although plate 38 provides a rigid support for ball 12, a support may also be configured which allows for some degree of upward and downward flexibility. For example, a plate or arms may be configured with a concavely curved upwardly facing surface of a mating configuration with the spherical outer surface of ball 12 such that the plate or arms are cantilevered to extend upwardly to free terminal ends which can flex downwardly or otherwise in response to downward movement of ball 12 such as when a user applies force by sitting on top of the ball. These cantilevered arms would likewise flex upwardly or otherwise when the downward force or weight is removed or reduced. Such arms could be formed of a relatively thin plate of metal such as steel or other material of suitable thickness to allow for such flexibility, and may also have various types of cushions positioned thereon between the metal of the arms and the outer surface of the inflated seat.

In the exemplary embodiment, no glue, adhesive, or other fastening devices are used to secure ball 12 to frame 14. Thus, ball 12 may be moved from the mounted position shown in FIG. 1 to the dismounted or removed position shown in FIG. 2 separate from the frame by a simple manual lifting force applied to the ball or seat. However, glue, adhesives or other fasteners may be used to secure ball 12 to frame 14. For instance, hooks, closed loops or links of a chain, or tethers, cords, or the like may extend from ball 12 to frame 14 in order to secure the ball to the frame. A seat back 40 is secured to support 32, typically including a relatively rigid rear portion attached to the support and a padded front section having a forward facing front surface against which the user leans during operation. Seat back 40 may be secured so that it is stationary relative to the frame, or may be movably mounted on the frame to, for example, tilt forward and rearwardly. In addition, seat back 40 may be vertically adjustable and longitudinally adjustable if desired.

Frame 14 includes a front section 42 and a rear section 44 which may be removably connected to one another and in the exemplary embodiment are selectively secured to one another by a length adjustment mechanism 46. Mechanism 46 is configured to allow for the adjustment of the length of frame 14 and the length between the seat and pedals, as indicated at arrow A in FIG. 2. The portion of frame member 28 which is within front section 42 includes a rear section in the form of a straight horizontal rigid rear member in the form of a tube 48 which splits at its front end into left and right rigid lower tubular forks 50A and 50B which are connected adjacent their front ends to front floor bar 24 and elevated support 30. A series of longitudinally spaced holes 52 are formed in rear tube 48 as well as in the front portion of frame member 33 such that the holes of each of these members may be aligned with one another to receive therethrough a securing peg 54 to secure the front and rear sections 42 and 44 to one another at a selected length of frame 14. In the exemplary embodiment, the front end of frame member 33 is slidingly or telescopically received within the hollow interior of rear tube 48. Although the use of holes 52 and peg 54 provides a simple securing mechanism for the length adjustment assembly, other suitable securing mechanisms known in the art may also be used. Elevated support 30 includes left and right rigid tubular upper forks 56A and 56B in the exemplary embodiment which are respectively secured to left and right lower forks 50A and 50B and extend upwardly and rearwardly therefrom.

A rigid flywheel housing 58 is secured to frame 14 generally adjacent front 16. In the exemplary embodiment, housing 58 is seated atop and secured to forks 50 and secured to the forward portions of upper forks 56. A set of left and right pedals 60A and 60B is rotatably mounted via a rigid crank or axle 62 about a horizontal axially extending axis B of axle 62. Crank 62 extends outwardly to the left and right from housing 58 with respective pedal arms 64A and 64B extending transversely and typically roughly perpendicularly to the crank 62. Left pedal 60A is rotatably mounted at the outer end of pedal arm 64A about a horizontal axially extending axis C of a left pedal axle such that axis C is parallel to and offset from axis B. Likewise, right pedal 60B is rotatably mounted at the end of pedal arm 64B about another horizontal axis D of a right pedal axle such that axis D is parallel to axes B and C and offset therefrom. The pedal axles of pedals 60A and 60B thus oscillate during operation along respective circular paths concentric about axis B while each pedal rotates about its respective pedal axle. Left and right crank-receiving holes 66A (FIGS. 1, 2) and 66B (FIGS. 5, 6) are formed respectively through the left and right sides of housing 58 for receiving therethrough respective portions of crank 62.

Rigid handle bars 68 are secured to the rear elevated free end of the cantilevered elevated support 30. Handle bars 68 include left and right segments with left and right front-grip handles 70A and 70B respectively secured to the terminal ends thereof. Handles 70 typically include grips similar to the grips of handles 36, and thus are formed of like materials and may include heart rate or pulse sensors. It is noted that handle bars 68 and/or handles 70 may be mounted in a variety of ways in order to allow them to move between various positions. For example, handle bars 68 may be pivotably mounted to allow handles 70 to move between various raised and lowered positions and secured at these various positions if desired. In addition, handle bars 68 and/or handles 70 may be adjustable in the axial or longitudinal directions in order to position the handles and secure them in accordance with the user's desire. Also secured to the free end of support 30 is a combination display and control unit 72 which typically includes a liquid crystal display (LCD) and various controls used in the operation of bike 10. The various controls are typically electrically operated and may utilize, for instance, various buttons, heat sensitive pads or pressure sensitive pads which can be manually operated. A variety of display functions may be displayed on the LCD of unit 72. For instance, these displays may include RPMs or revolutions per minute of the pedals during rotation, the amount of time that the bike has been operated by the user, the simulated speed at which the user would be traveling on a real bicycle, the simulated distance that would be traveled on a wheeled bicycle, the calories burned during the workout, the pulse or heart rate of the user during training, the current room temperature in which the bike is operated, a calendar showing the day, month and year, a clock indicating the current hour and minute and so forth. The display may include a scan option which runs between various display functions to allow the user to track various monitors and/or training programs. The display may also include a video screen to allow the user to watch videos, television, and/or speakers to assisting the same or listen to music and so forth. The display is in electrical communication with built-in heart rate or pulse sensors in the grips or handles 36 and 70.

Referring primarily to FIG. 2, arcuate left and right arms 34A and 34B of the frame include respective left and right rear segments 74A and 74B which extend respectively axially outwardly substantially horizontally from upright 32, respective intermediate segments 76A and 76B which extend respectively forward from rear segments 74A and 74B, and front segments 78A and 78B which extend respectively downwardly from the front of intermediate segments 76A and 76B. Front segments 78A and 78B adjacent their lower ends extend axially inwardly toward their rigid connection with frame member 33. More particularly, left and right rear segments 74A and 74B extend axially outwardly along a generally straight line from upright 32 for a short distance and then curve forward and slightly upwardly to transition respectively into left and right intermediate segments 76A and 76B, which curve forward and downwardly to transition into left and right front segments 78A and 78B. As viewed from above, the axial outer ends of rear segments 74A and 74B and the rear portions of intermediate segments 76A and 76B curve so that their inner surfaces 85 curve concavely and face generally forward and axially inward toward one another and plane P1 while their outer surfaces 87 curve convexly and face generally rearwardly and axially outward away from one another and plane P1. As viewed from the side, the bottom downwardly facing surfaces 89 of intermediate segments 76A and 76B curve concavely, while their top upwardly facing surfaces 91 curve convexly. As viewed from the side, the rearwardly facing back surfaces 93 of front segments 78A and 78B curve concavely while their front forward facing surfaces 95 curve convexly. The lower ends of front segments 78A and 78B curve rearwardly to their respective connections 43 with frame member 33. As viewed from the front or from the side, the top upwardly facing surfaces 97 of the lower portions of front segments 78A and 78B adjacent the connection with frame member 33 curve concavely while their bottom downward facing surfaces 99 curve convexly.

Frame 14 adjacent rear end 18 defines a ball receiving space 75 having a top entrance opening 77, a front entrance opening 79, a left rear entrance opening 81 and a right rear entrance opening 83. Ball-receiving or seat-receiving space 75 is generally defined between arms 34A and 34B, forward of upright 32 and above ball support 38. In the exemplary embodiment, the top surface of ball support 38 defines the bottom of space 75, the front of upright 32 defines the back of space 75 and portions of intermediate segments 76 and/or front segments 78 of arms 34 typically define the left and right sides of space 75. Top entrance opening 77 is defined between intermediate segments 76A and 76B while front entrance opening 79 is defined between front segments 78A and 78B. Left rear entrance opening 81 is defined generally between left arm 34A, upright 32, ball support 38 and the rear portion of frame member 33 extending rearwardly from ball support 38. Similarly, right rear entrance opening 83 is defined generally between right arm 34B, upright 32, ball support 38 and the rear portion of frame member 33 extending rearwardly from support 38. In the exemplary embodiment, each of the entrance openings 77, 79, 81 and 83 is completely or substantially free of any components extending between the various structures which define said entrance openings. In the exemplary embodiment, machine 10 is free of or substantially free of components extending into space 75 other than inflated seat 12.

As shown in FIG. 2, inflatable seat 12 is formed of a substantially spherical bladder or wall 80 having a substantially spherical outer surface 82 and a substantially spherical inner surface 84 defining therewithin a spherical interior chamber 86 when seat 12 is inflated and in a state of rest in which it is substantially not compressed other than by its own weight when seated on a surface. Bladder or wall 80 is typically formed of a rubber or elastomer which is flexible and stretchable while also being thick enough to support a user seated thereon during the operation of bike 10. FIG. 2 also shows that outer surface 82 defines an outer diameter d which in the inflated resting state is usually within a range of about 50 or 55 centimeters to about 60 or 65 centimeters and more broadly within a range of about 35, 40 or 45 centimeters to about 65, 70 or 75 centimeters.

When inflated seat 12 is mounted at rest on frame 14 as shown in FIGS. 1 and 5, the bottom of outer surface 82 is seated on the horizontal top surface of plate 38, while a rearward portion of the outer surface about midway between the top and bottom of sphere 12 is typically closely adjacent or abutting the front of seat support 32, and left and right lower portions of the outer surface 82 in the forward half of the spherical seat 12 are closely adjacent or abutting the lower portions of front segments 78A and 78B. Typically, outer surface 82 has essentially only a four-point contact with frame 14 at the locations noted above. Typically, intermediate segments 76A and 76B are spaced outwardly from seat 12 and are thus not in contact with outer surface 82 of seat 12 at rest or when compressed when a user is seated thereon. Also typically, the above noted places of contact or interface between the outer surface of the sphere and the various surfaces of frame 14 are the only places of contact between the ball and frame when the inflated ball is at rest whereby the remainder of outer surface 82 is out of contact with frame 14. The portions of the frame which extend upwardly and contact the outer surface of seat 12 substantially prevent it from rolling atop plate 38. Seat 12 is also substantially non-rotatably mounted within space 75 due to frictional engagement (or securing devices if used) between seat 12 and frame 14. In its operational configuration, interior chamber 86 is filled with a gas, which is most typically air. Thus, bladder or wall 80 is formed of a material which is impermeable to air or any other gas used therein. Seat 12 may or may not include an air inlet with a valve in order to allow the bladder to be inflated or deflated.

When sphere 12 is inflated and in its resting state, frame 14 is configured to receive seat 12 within receiving space 75 through top entrance opening 77 and typically through a portion of front entrance opening 79, which together form an entrance opening which extends generally upwardly and forward along intermediate segments 76 and front segments 78. Seat 12 is thus inserted downwardly either substantially vertically or downwardly and rearwardly through entrance opening 77 and a portion of opening 79 until it is seated atop ball support 38. This downward or downward and rearward insertion of the sphere into space 75 may or may not involve compression of the inflated seat against certain portions of arms 34. If such compression does occur, it is typically due to a sliding engagement between the outer surface of the sphere and the lower portions of front segments 78 and/or support 32.

Once seat 12 is properly positioned within space 75, the lower portions of front segments 78 may abut the outer surface of the sphere in its resting state. The lower portions of front segments 78 will generally prevent the ball from rolling forward out of space 75 through front entrance opening 79. Although the ball might be forced horizontally forward out of space 75 through front entrance opening 79, this would typically require a substantial amount of force in order to provide sufficient compression of the ball against and between segments 78A and 78B to move through entrance opening 79. Generally, left and right rear entrance openings 81 and 83 are configured so that at least one dimension of the respective entrance opening is sufficiently less than the diameter of the inflated ball in order to prevent it from moving through the respective entrance opening during use of machine 10. When inflated ball seat 12 is positioned at a state of rest in receiving space 75, side grip handles 36 are at a height which is about the same as the top of the ball although they may be slightly higher or lower, while intermediate segments 76 are at a height which is also similar to the height of the top of the ball although typically somewhat below this height. Handles 36 and intermediate segments 76 are typically substantially above the height of the midway point between the top and bottom of the ball, (the center X of the ball) and typically at least ¾ of the height of the ball. The forward most point of each front segment 78 is typically spaced longitudinally forward from the seat support about the same distance as the front most portion of ball 12 and somewhat rearward thereof in the exemplary embodiment although it may be forward thereof as well. As previously noted, FIGS. 3 and 4 show modified versions of the inflatable seat. Inflatable seat 12A shown in FIG. 3 is substantially spherical although the bladder or wall 80A is modified somewhat relative to that of wall 80 of seat 12. Bladder 80A includes a substantially spherical wall portion 88 and a recessed wall portion 90 which is secured to the bottom area of wall portion 88 and extends upwardly and inwardly therefrom. Recessed wall portion 90 includes an annular side wall 92 which is typically either cylindrical or frustoconical in shape although other shapes may be used, and a top wall 94 secured to the top of annular side wall 92. Side wall 92 and top wall 94 define therewithin a bottom recess 96 having a bottom entrance opening 98 which communicates with outer surface 82 of spherical wall portion 88. Recessed wall portion 90 thus projects inwardly into interior chamber 86 such that recess 96 is circumscribed or entirely surrounded by the bottom portion of interior chamber 86 extending radially outwardly from annular side wall 92 relative to a vertical axis passing through the center of recess 96. The outer surface 82 of bladder 80A also has a diameter which is within the range as noted above with regard to bladder 80.

Frame 14 is altered in accordance with the use of inflatable seat 12A. More particularly, frame 14 includes an insert or projection 100 which is rigidly secured to and extends upwardly from plate 38 and has an outer surface which is of a mating configuration with the surface of recessed wall portion 90 defining recess 96. Insert 100 thus includes an annular side wall 102 which is typically either cylindrical or frustoconical in shape although other shapes may be suitable. Insert 100 further includes a top wall 104 secured to the top annular side wall 102. Insert 100 is essentially a post which extends upwardly and may be formed as a solid structure as well. When insert 100 is received in recess 96, it is thus circumscribed or completely surrounded by side wall 92 and the lower portion of interior chamber 86 extending radially outwardly from side wall 92. The use of the recess 96 and insert 100 therein thus provides a different way of mounting an inflatable seat on the frame to substantially prevent it from rolling thereon. During use of seat 12A, recessed wall portion 90 typically remains substantially fixed or stationary while on the substantially spherical portion 88 is flexibly movable relative thereto during compression and decompression as the user sits on and moves about on seat 12A. The insert 100 and recess 96 may be configured such that seat 12A may simply be lifted off of insert 100 inasmuch as there may be no more than a frictional engagement between the recessed wall portion 90 and insert 100 or perhaps a stretch fit in which recessed wall portion 90 may be required to stretch in order to fit over and be removed from insert 100. A glue, adhesive or other fastener may also be used to help secure the outer surface of insert 100 to recessed wall portion 90.

As noted above, alternate inflatable seat 12B and an alternate mounting structure are illustrated in FIG. 4. Seat 12B is substantially hemispherical in shape and includes a bladder or wall 80B having a substantially hemispherical wall portion 106 and a substantially flat circular bottom wall portion 108 secured to the bottom thereof in order to define a substantially hemispherical interior chamber 86. Frame 14 is modified to include an upright or support 110 which is rigidly secured to and extends upwardly from frame member 33 with a substantially flat circular horizontal plate or disc 112 rigidly secured to the top thereof. Bottom wall portion 108 during operation thus remains substantially fixed or stationary while the hemispherical wall portion 106 is flexibly and stretchably movable in response to the movements of the user while seated thereon. The flat bottom surface of bottom wall portion 108 is thus secured to the flat top surface of plate 112, typically with glue or some form of adhesive. Other known securing mechanisms such as Velcro® or the like may also be used. Outer surface 82 of bladder 80B adjacent bottom wall portion 108 defines an outer diameter as measured horizontally which is typically on the order of about 40 centimeters, usually within a range of 30 to 35 centimeters to 45 or 50 centimeters and more broadly within a range of about 25 centimeters to about 55 or 60 centimeters. The diameter of bottom wall portion 108 thus also falls within these ranges.

Referring now to FIG. 5, housing 58 includes left and right vertical panels 114A and 114B (left panel 114A shown in FIG. 1). Housing 58 further includes a perimeter wall 116 which is connected to the respective outer perimeters of vertical panels 114 whereby panels 114 and perimeter wall 116 define therewithin an interior chamber 117 of housing 58. A generally flat and vertically oriented flywheel 118 is disposed within interior chamber 117 with crank 62 rigidly secured at its center and extending outwardly therefrom to the left and right. More particularly, holes 66A and 66B are formed respectively in left and right vertical panels 114A and 114B such that crank 62 extends axially outwardly from flywheel 118 therethrough. A drive sprocket or pulley 119 is secured to one side of flywheel 118 with its outer perimeter concentric about axis B. A resistance mechanism 120 is provided within interior chamber 117 in order to allow the user to control the amount of resistance on flywheel 118 and thus to the pedaling motion of the user. A variety of resistance mechanisms may be used, such as a flexible resistance belt which wraps around the outer perimeter of flywheel 118 which may be tightened or loosened to adjust the resistance, a rigid brake which may likewise be forced against flywheel 118 to a greater or lesser degree in order to adjust the resistance, or a magnetic resistance mechanism (which eliminates friction via components otherwise applied against the flywheel during rotation). In addition, an adjustable air resistance system may be provided for example by a momentum washboard flywheel or a fan wheel.

An air compressor 122 is also disposed within interior chamber 117 with a driven sprocket or pulley 124 rotatably mounted on a drive shaft of compressor 122. A flexible drive chain or belt 126 which forms a closed loop wraps around drive pulley 119 and driven pulley 124 such that the rotational movement of drive pulley 119 causes belt 126 to move in a revolving pattern to drive driven pulley 124 in order to power air compressor 122 to produce compressed or pressurized air. An electronic control unit 128 having a microprocessor is also typically disposed in interior chamber 117. Air compressor 122 is in fluid communication with interior chamber 86 of seat 12 via an air conduit 130 having a first end 132 secured to compressor 122 and a second opposed end 134 connected to the bottom of bladder 80. An air valve 136 is provided along air conduit 130 for controlling the flow of air through conduit 130. Control unit 128 is in electrical communication with air valve 136 via an electrical conductor or wire 138. A height sensor 140 is mounted adjacent the bottom of bladder 80 within interior chamber 86 of seat 12. Control unit 128 is in electrical communication with sensor 140 via an electrical conductor or wire 142.

FIG. 5 shows that plate 38A is modified with a hole 144 through which conduit 130 and wire 142 pass. In the exemplary embodiment, conduit 130 and wire 142 extend primarily through the hollow tube formed by portions of the front and rear sections of frame member 28. Bladder 80 may include a thickened mounting portion 146 adjacent its bottom in order to provide sufficient support to sensor 140 and conduit 130 adjacent its second end 134. As shown in FIG. 5, outer surface 82 of bladder 80 includes an upwardly facing seating surface 148 at the top of the inflatable seat which is at a height H1 relative to frame 14 and floor F when the inflatable seat 12 is in its resting state or position. A reference point P is provided on inner surface 84 which in the exemplary embodiment is directly below seating surface 148 although this may vary.

Figure 6:
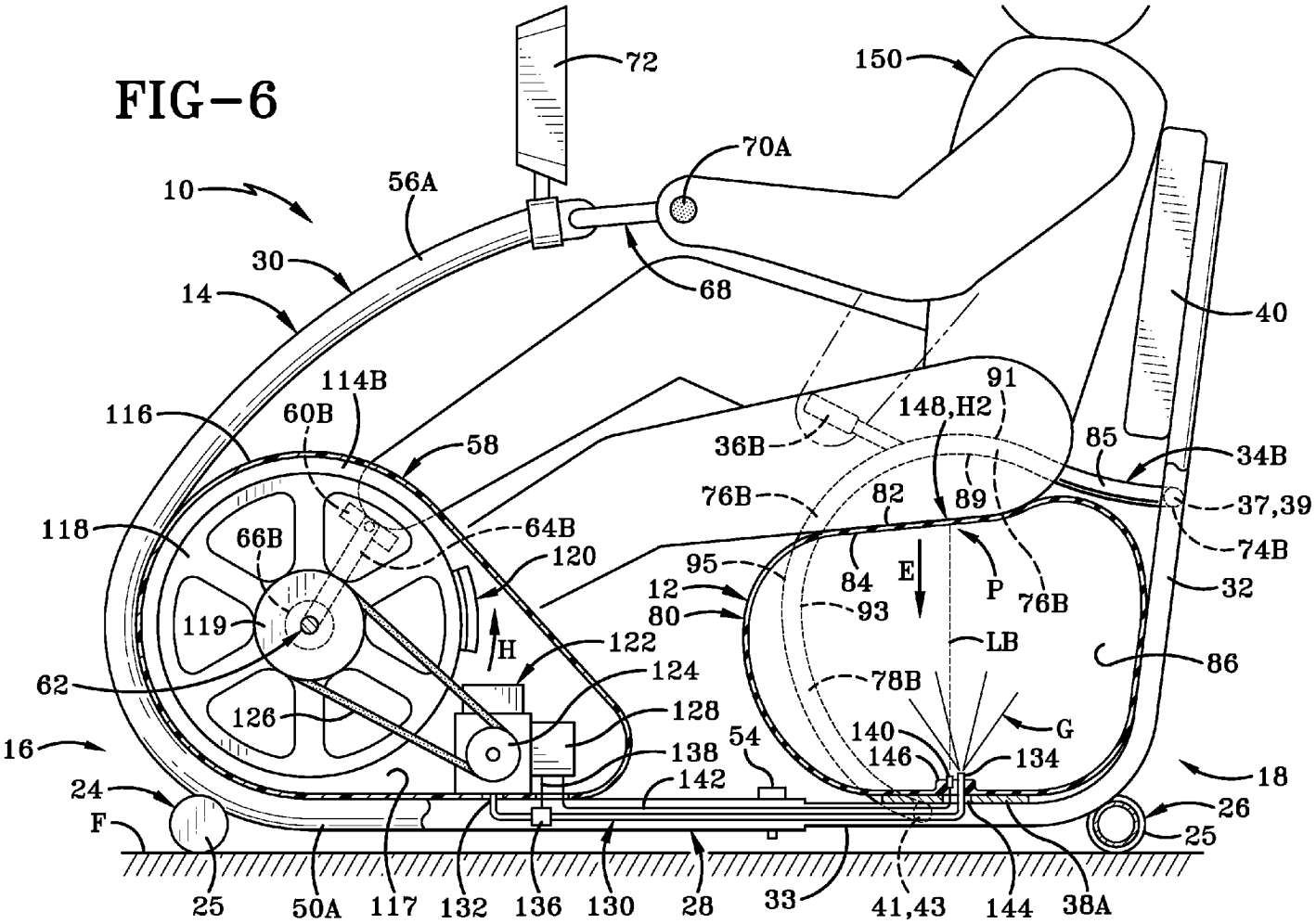
FIG. 6 is similar to FIG. 5 and shows the user of the machine seated on the inflatable seat which is compressed to a certain degree to show one of many possible compressed positions.

The operation of bike 10 is now described with primary reference to FIGS. 5 and 6. As illustrated in FIG. 5, sensor 140 is used to measure the vertical distance between sensor 140 and reference point P such as by emitting a suitably low powered laser beam LB which is directed at reference point P and which is typically reflected back and sensed by sensor 140 in order to provide a signal to the microprocessor of control unit 128 to establish this vertical distance and thus height H1. When the user or person 150 sits down on seating surface 148 as illustrated in FIG. 6, the bladder 80 is flexibly and stretchably deformed and compressed by the weight of the user such that the upper portion of bladder 80 including seating surface 148 moves downwardly as indicated at arrow E to a lower height H2. Reference point P accordingly moves downwardly such that the vertical distance from sensor 140 and point P is reduced relative to the resting state shown in FIG. 5. Laser beam LB is thus reflected a shorter distance such that it is sensed to form a signal which is translated by the microprocessor in order to determine the vertical distance and thus height H2. Obviously, the difference between height H1 and height H2, and thus the degree to which seating surface 148 moves downwardly from height H1, depends upon the weight of the person 150 seated on seat 12. Inasmuch as height H2 may thus be higher or lower than the most preferred or desired height for operation of bike 10, the pneumatic system may thus be controlled by control unit 128 in order to either further inflate or deflate inflatable seat 12 (adjust the internal pressure of bladder 80) in order to adjust the height of seating surface 148 to the desired position. More particularly, if height H2 is determined by unit 128 is determined to be too high, control unit 128 is able to control valve 136 in order to allow bladder 80 to be suitably deflated or reduce its internal pressure in order to lower the seating surface 148 to the appropriate height. If the height of seating surface 148 is determined to be too low, control unit 128 is likewise able to control valve 136 in order to allow compressed air from compressor 122 to further inflate seat 12 or increase the internal pressure of bladder 80, as indicated by the lines G, which illustrate air or another gas moving into interior chamber 86. In the exemplary embodiment, air compressor 122 is powered by user 150 as the user pedals or applies the appropriate rotational force to the pedals in order to rotate the pedals, flywheel 118 and drive pulley 119 in order to drive the driven pulley 124 via belt 126 to operate air compressor 122.

It is noted that the movement of the inflated seat 12 from its resting state in FIG. 5 to its compressed state in FIG. 6 in response to the downward force of the user seated thereon not only obviously alters the shape of the seat, but also increases the surface area of contact between outer surface 82 and frame 14. More particularly, FIG. 5 illustrates that the outer surface at the bottom of the sphere 12 contacts only a portion of the top surface of plate 38A in the resting state whereas the surface area of contact between outer surface 82 and the top surface of plate 38A in the compressed position of FIG. 6 shows that the entire top surface of plate 38A is in contact with outer surface 82. In addition, FIG. 5 shows a relatively small contact area between the front of upright 32 and the rear portion of outer surface 82 in the resting state of FIG. 5 while FIG. 6 shows a substantially greater contact surface area between outer surface 82 and the front of upright 32 in the compressed state of the inflated seat. Similarly, the contact surface area between outer surface 82 and the lower portion of front segments 78 increases from the resting state of FIG. 5 to the compressed state of FIG. 6.

As illustrated in FIG. 6, the user 150 typically will rest his or her back against seat back 40 while seated on inflatable seat 12 and pedaling the stationary bike. The user may hold on to handles 70 as illustrated in solid lines, or handles 36 as illustrated in dashed lines. Pulse or heart rate sensors in handles 70 or 36 are configured to sense the user's pulse and send corresponding signals to control unit 128 in order to display the pulse or heart rate of the user while exercising on bike 10. The user seeking a more challenging workout may choose not to hold on to any handles at all and furthermore may not lean against back rest 40. Regardless of the alternate position for the hands, bike 10 provides a combination of a cardiovascular workout primarily via the pedaling of the bike along with a core workout primarily for the abdominal and back muscles primarily via inflatable seat 12. More particularly, the nature of inflatable seat 12 means that seating surface 148 does not remain stationary while the user's feet are applying force to pedals 60 in order to pedal bike 10. This movement of seating surface 148 is primarily due to the inflatable aspect of seat 12 along with the flexible and stretchable material of which bladder 80 is formed whereby seating surface 148 is able to move in any direction relative to frame 14. Thus, user 150 is faced with the additional challenge of balancing on seat 12 while simultaneously pedaling the bike. As a result, user 150 is forced to use abdominal muscles and back muscles to a substantially larger degree than would occur with a simple pedaling workout on a stationary seat.

Bike 200 is now described with reference to FIGS. 7-12. Bike 200 is particularly configured to use the spherical seat 12 which was described in greater detail above although modifications may be made to use other seats such as seat 12A and seat 12B also described previously. Bike 200 includes a rigid frame 214 typically made of a metal such as steel or the like. Frame 214 has a front 16 and a back 18 defining therebetween a longitudinal direction of the frame and bike. Frame 214 has left and right sides 20 and 22 defining therebetween an axial direction of the frame and the bike. In the exemplary embodiment, frame 214 is configured as a free standing frame which is typically seated on a floor F (FIGS. 7-9) although it may be secured otherwise.

Frame 214 includes a rigid tubular axially elongated front floor or stability bar 24 and a rigid tubular axially elongated rear floor or stability bar 26 which is substantially parallel to bar 24. Each of bars 24 and 26 is typically straight and horizontal and has left and right feet in the form of end caps 25 mounted thereon so that the lower portions of feet 25 extend respectively downwardly from bars 24 and 26 and are seated on or contact floor F. Feet 25 are typically formed of a material which resists sliding along the floor and is sufficiently soft to minimize or eliminate scratching the floor, for example, rubber, an elastomer, plastic, fabric or the like. Frame 214 further includes a bottom longitudinal frame member 228 which is longitudinally elongated and extends horizontally between and is rigidly secured to bars 24 and 26. Each of bars 24 and 26 have respective left and right segments which extend axially outwardly in opposite directions from their connection with frame member 228. Bars 24 and 26 thus provide suitable stability to bike 200 when seated on the floor. Bars 24 and 26 and frame 228 are adjacent floor F when exercise machine 200 is seated thereon.

Frame 214 further includes a rigid front elevated support 230 which is rigidly secured to and extends upwardly from the front of frame member 228 and then rearwardly to a rear end. Frame 214 further includes a rigid crank support assembly which supports various components as noted further below. The crank assembly includes a crank support bar 201 which extends upwardly and rearwardly and an additional crank support bar 202 which extends rearwardly and downwardly to a rigid connection with support bar 201. Frame 214 also includes a rigid rear seat back support 232 which is rigidly secured to the rear section of frame member 228 and extends upwardly therefrom. Longitudinal frame member 228 includes a rigid tubular straight horizontal rear longitudinal frame member 233 which is substantially horizontal and has front and rear ends 203 and 204 defining therebetween a longitudinal interior chamber 205. Rear end 204 is rigidly secured to the front of rear bar 26. Frame 214 further includes rigid tubular left and right arms 234A and 234B which are secured to upright support 232 and extend respectively axially outwardly therefrom, and forward and downwardly to frame member 233. In the exemplary embodiment, left and right arms 234A and 234B are mirror images of one another and thus are bilaterally symmetrical about a vertical central longitudinally extending plane P1 (FIGS. 9-12) passing through the center of exercise machine 200 midway between left and right sides 20 and 22.

Rear seat back support 232 includes left and right rigid support members 235A and 235B each of which in the exemplary embodiment is formed of a single elongated tube which is bent to form a front lower horizontal longitudinal segment 245, an arcuate back segment 247 which curves upwardly and rearwardly from segment 245, and a straight upper segment 249 which extends upwardly from arcuate segment 247. More particularly, each arcuate segment 247 has a lower front end which is secured to the rear end of horizontal segment 245 at a lower connection or transition 251. The bottom end of each straight segment 249 is secured to the top of each arcuate segment 247 at an arcuate upper connection or transition 252 which curves in the opposite direction of segment 247. Each arcuate segment 247 has a concavely curved front surface 253 and a convexly curved back surface 255 which curve parallel to one another and lie along arcs of respective circles which are concentric about center X (FIG. 7) of inflated sphere 12 as viewed from the side. Front surface 253 extends from the connection or transition 251 rearwardly and upwardly to a height equal to that of center X such that surface 253 between the said height and transition 251 faces upwardly and forward. Surface 253 continues upwardly from the height of center X, curving upwardly and forward therefrom to transition 252 whereby surface 253 between transition 252 and the height of center X faces forward and downwardly. As viewed from the rear (FIG. 9), each of support members 235 appears straight and vertical whereby each lies along a respective plane parallel to plane P1. Left and right members 235A and 235B are substantially identical to one another or are mirror images of one another such that they are bilaterally symmetrical with respect to plane P1.

Figure 8:
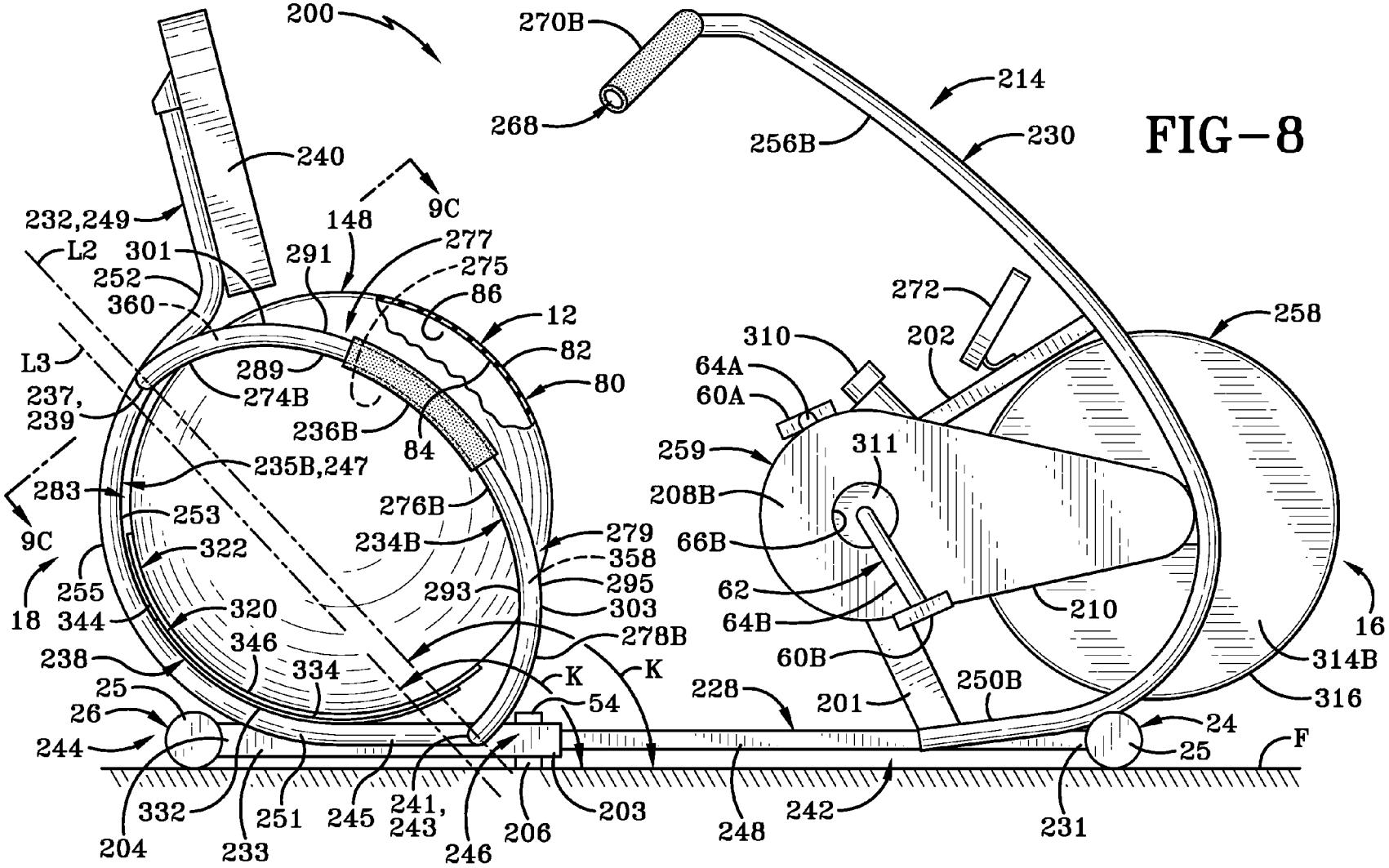
FIG. 8 is a right side elevational view of the second embodiment with a portion of the inflatable seat cut away and shown in section.

Each arm 234 in the exemplary embodiment is formed of a single tube which thus extends from a first or rear end 237 attached at a rigid connection 239 to one of segments 247 below and rearward of transition 252 to a second or forward end 241 attached at a rigid connection 243 to the front end of segment 245 at or adjacent frame member 233. Rear end 237 and connection 239 are rearward and higher than forward end 241 and connection 243. FIG. 8 illustrates a line L2 extending through the respective centers of ends 237 and 239 or connections 239 and 243 whereby line L2 and a horizontal plane such as floor F define therebetween an obtuse angle K which illustrates in part that line L2 angles upwardly and rearwardly. In the exemplary embodiment, angle K is typically about 135 degrees and more broadly in the range of about 120, 125 or 130 degrees to about 140, 145 or 150 degrees although this may vary. Left and right side-grip handles or grips 236A and 236B are respectively secured around left and right arms 234A and 234B and are typically formed of a resilient compressible material such as a foam, rubber or elastomer. These grips of the handles may have built-in heart rate or pulse sensors. Arms 234 are described in greater detail further below.

Frame 214 further includes arcuate ball support 238 which supports ball 12 and is described in greater detail further below. In the exemplary embodiment, no glue, adhesive, or other fastening devices are used to secure ball 12 to frame 214. Thus, ball 12 may be moved from the mounted position shown in FIGS. 7-12 to a dismounted or removed position analogous to that shown in FIG. 2 separate from the frame by a simple manual lifting force applied to the ball or seat. However, glue, adhesives or other fasteners may be used to secure ball 12 to frame 214. For instance, hooks, closed loops or links of a chain, or tethers, cords, or the like may extend from ball 12 to frame 214 in order to secure the ball to the frame. A seat back 240 is secured to support 232 as discussed above with regard to seat back 40.

Figure 7:
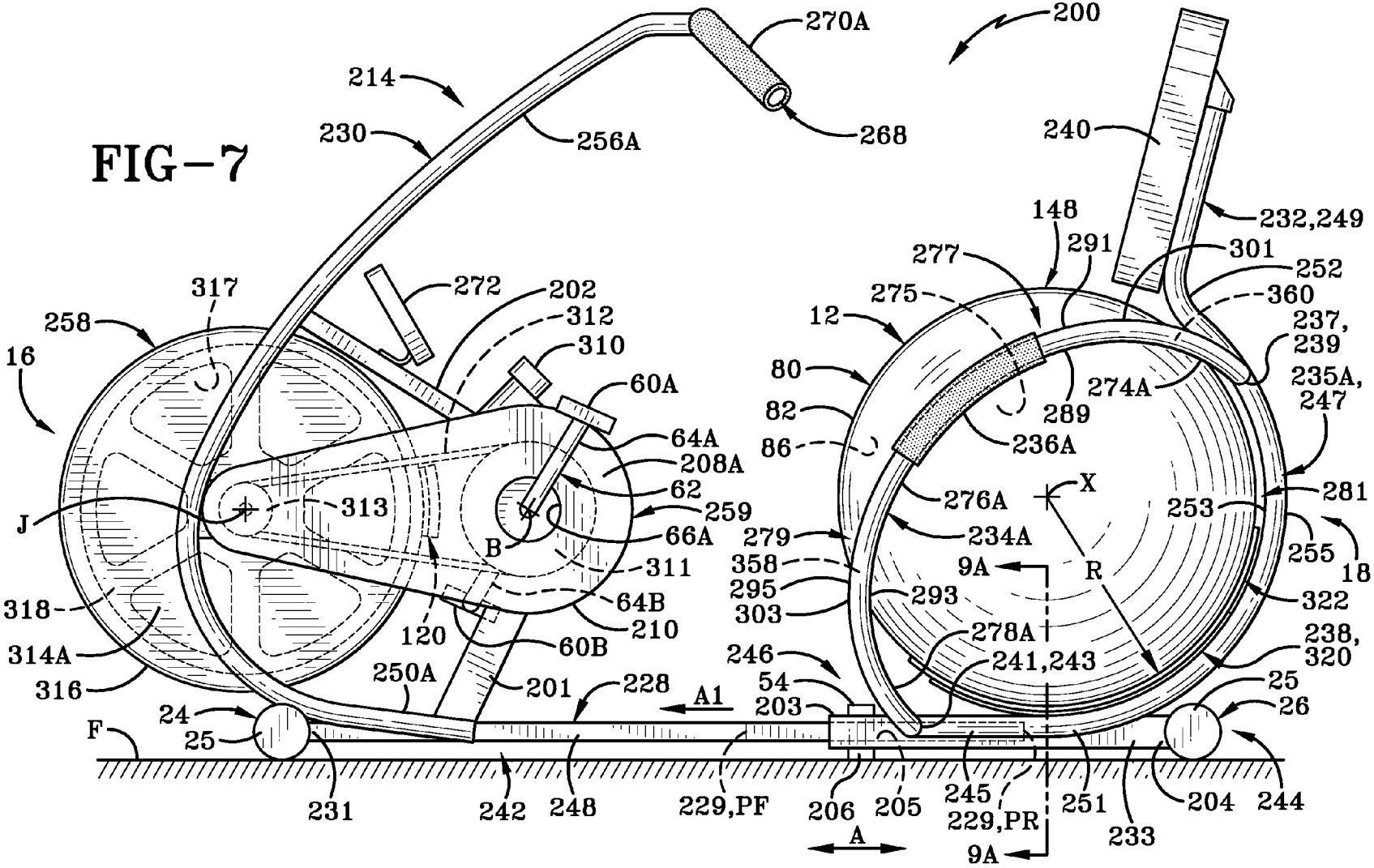
FIG. 7 is a left side elevational view of a second embodiment of the stationary bicycle of the present invention.

Frame 214 includes a front section 242 and a rear section 244 which is typically removably connected to one another and in the exemplary embodiment are selectively secured to one another by a securing mechanism 246 which serves as a length adjustment and detachment mechanism. Mechanism 246 is configured to allow for the adjustment of the length of frame 214 and the length between the seat and pedals, as indicated at arrow A in FIG. 7. The portion of frame member 228 which is within front section 242 includes a straight horizontal rigid member in the form of a tube 248 having a rear end 229 and a front end 231 rigidly secured to front bar 24. Left and right rigid tubular members 250A and 250B of support 230 are rigidly connected along their lower rear ends to opposed sides of tube 248 and also to the upper portion of front floor bar 24. Tubular members 250A and 250B include respective left and right upper segments 256A and 256B. A series of longitudinally spaced holes 52 (FIG. 11) are formed in the rear section of tube 248 as well as in the front portion of frame member 233 such that the holes of each of these members may be aligned with one another to receive therethrough a securing peg 54 to secure the front and rear sections 242 and 244 in a secured position to one another at a selected length of frame 214. In the exemplary embodiment, the rear end 229 of frame member 248 is slidingly or telescopically received within the hollow interior chamber 205 of tubular member 233, for instance at a rear position PR (FIG. 7). Although the use of holes 52 and peg 54 provides a simple securing mechanism for the length adjustment assembly, other suitable securing mechanisms known in the art may also be used.

As noted above, mechanism 246 may also serve as a detachment mechanism for detaching front section 242 from rear section 244. More particularly, peg 54 may be removed from holes 52 to an unsecured position to allow tube 248 to slide forward (Arrow A1 in FIG. 7) relative to the rear section in order to entirely remove tube 248 from within interior chamber 205, as illustrated in dashed lines by end 229 being located at forward position PF. Preferably, a forward foot 206 is secured to and extends downwardly from the bottom surface of frame member 233 adjacent front end 203, which in the exemplary embodiment is adjacent the forward lower ends 241 of arms 234 and adjacent connections 243. Thus, when front section 242 is detached from rear section 244, foot 206 contacts floor F when seated thereon along with rear feet 25 mounted on bar 26, thereby providing a three-point contact with floor F. Foot 206 is formed of the same type of material discussed above with regard to feet 25 in order to substantially prevent scratching floor F when seated thereon. Rear section 244 and seat 12 are thus configured as a separate seat assembly which can be used simply as a seat or chair, or as a separate exercise device when detached from front section 242.

A rigid flywheel housing 258 is secured to frame 214 generally adjacent front 16. In the exemplary embodiment, housing 258 is secured to tubes 250. A rigid crank housing 259 is also secured to frame 214 generally adjacent front 16. In the exemplary embodiment, housing 259 is secured to housing 258 and extends rearwardly therefrom to a connection with support bars 201 and 202 of the crank support assembly. Housing 258 and 259 may be formed as a single unit or separate components. A set of left and right pedals 60A and 60B is rotatably mounted via a rigid crank or axle 62 about a horizontal axially extending axis B (FIGS. 7, 10) of axle 62. Crank 62 extends outwardly to the left and right from housing 259 with respective pedal arms 64A and 64B extending transversely and typically roughly perpendicularly to the crank 62. Left pedal 60A is rotatably mounted at the outer end of pedal arm 64A about a horizontal axially extending axis C (FIG. 10) of a left pedal axle such that axis C is parallel to and offset from axis B. Likewise, right pedal 60B is rotatably mounted at the end of pedal arm 64B about another horizontal axis D of a right pedal axle such that axis D is parallel to axes B and C and offset therefrom. The pedal axles of pedals 60A and 60B thus oscillate during operation along respective circular paths concentric about axis B while each pedal rotates about its respective pedal axle. Left and right crank-receiving holes 66A (FIGS. 1, 2) and 66B (FIGS. 5, 6) are formed respectively through the left and right sides of housing 259 for receiving therethrough respective portions of crank 62.

Rigid handle bars 268 are secured to the rear elevated free end of the cantilevered elevated support 230. Handle bars 268 include left and right segments with left and right front-grip handles 270A and 270B respectively secured to the terminal ends thereof. Handles 270 typically include grips similar to the grips of handles 236, and thus are formed of like materials and may include heart rate or pulse sensors. It is noted that handle bars 268 and/or handles 270 may be mounted in a variety of ways in order to allow them to move between various positions as discussed above with regard to handle bars 68 and handles 70. A combination display and control unit 272 is secured to upper bar 202 and extends upwardly therefrom. Display 272 includes the same features as discussed above with regard to unit 72. Display 272 is in electrical communication with built-in heart rate or pulse sensors in the grips or handles 236 and 270. A resistance control 310 is also mounted on the crank support assembly above housing 259.

Figure 9:
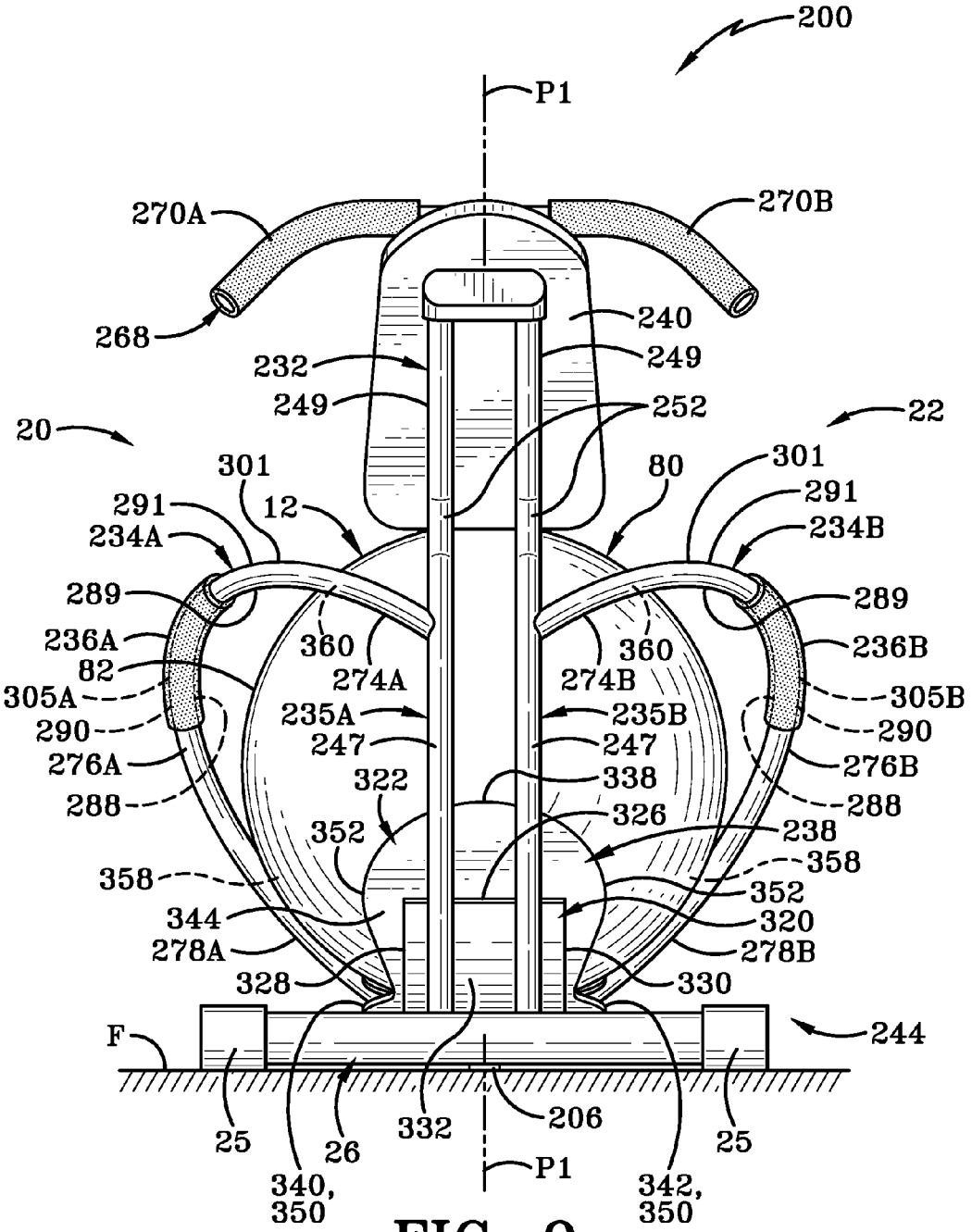
FIG. 9 is a rear end elevational view of the second embodiment.
Figure 9A:
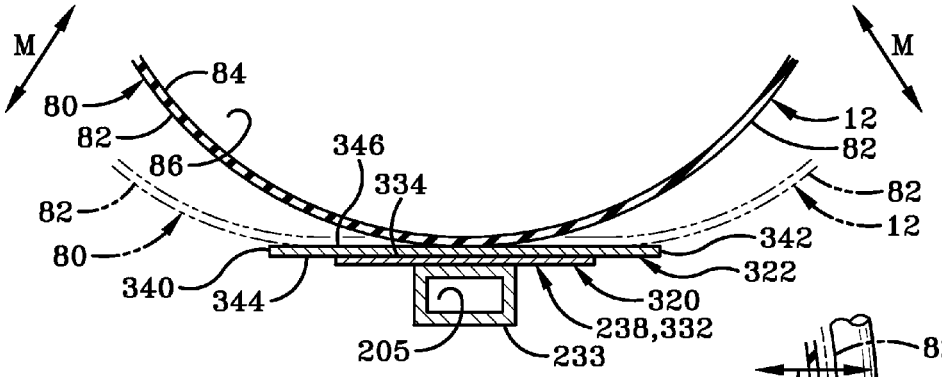
FIG. 9A is a sectional view taken on line 9A-9A of FIG. 7.
Figure 12:
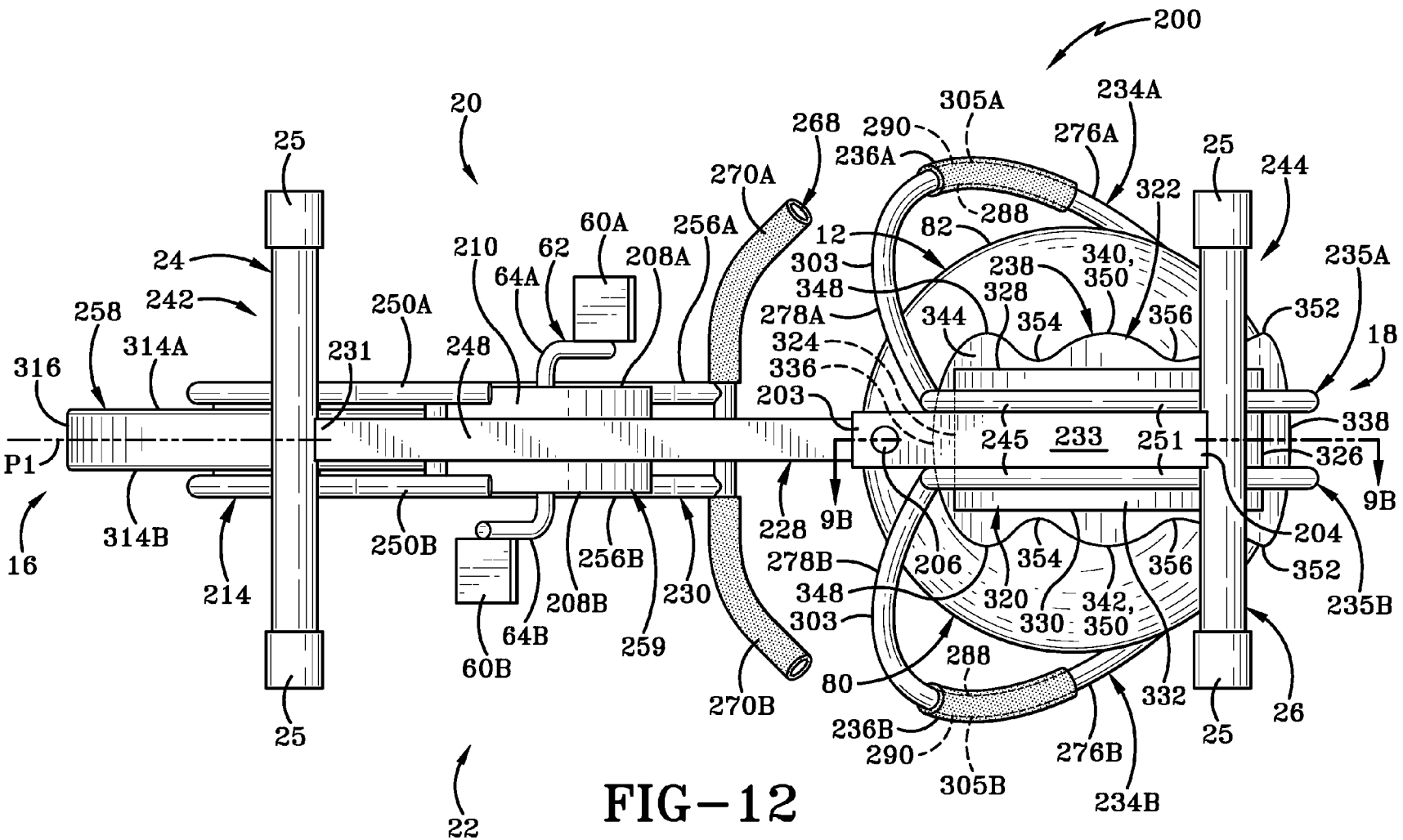
FIG. 12 is a bottom plan view of the second embodiment.

With primary reference to FIGS. 7, 9A, 9B and 12, ball support 238 is now described in greater detail. Support 238 includes a first or bottom plate 320 and a second or top plate 322 each of which is curved as viewed from the side. In the exemplary embodiment, bottom plate 320 is formed of a rigid material such as steel or another metal. However, plate 320 is sufficiently thin to allow for some flexing as described further below. Bottom plate 320 is typically formed of a spring metal. Top plate 322 is in the exemplary embodiment formed of a material which is less rigid than the material of bottom plate 320. In the exemplary embodiment, top plate 322 is formed of a fairly rigid and resilient plastic which thus also allows for some flexibility and, like plate 320, the ability to return to its original position once the force causing it to flex has been removed. Bottom plate 320 has front and back axially elongated parallel ends or edges 324 and 326. Back edge 326 in the exemplary embodiment is rearward of and higher than front edge 324. Plate 320 also has left and right longitudinally elongated parallel edges 328 and 330 extending from the front edge 324 to back edge 326 and intersecting the front and back edges at respective right angled corners. Edges 324, 326, 328 and 330 thus form an outer perimeter of plate 320 as viewed from below (FIG. 12). Bottom plate 320 has a downwardly facing bottom surface 332 and an upwardly facing top surface 334 each of which extends from front edge 324 to back edge 326 and from left edge 328 to right edge 330. As shown in FIG. 9A, bottom plate 320 and thus its lower and upper surfaces 332 and 334 are straight and horizontal as viewed in a cross section looking forward. As viewed from the side (FIGS. 7, 8, 9B), bottom surface 332 is convexly curved from front edge 324 to back edge 326 and forms an arc of a circle which is concentric about center X of sphere 12. As viewed from the side, top surface 334 is concavely curved from front edge 324 to back edge 326 and lies along an arc of a slightly smaller diameter circle which is concentric about center X.

The radius of curvature of bottom surface 332 is substantially the same as that of front surface 253 of each support member 235.

Bottom plate 320 is rigidly secured to support members 235 with bottom surface 332 in contact with front surface 253 from back edge 326 for a substantial distance to about the transition 251 between segments 245 and 247. Bottom surface 332 is thus in a mating engagement with front surface 253 and in continuous contact from back edge 326 toward front edge 324 along a distance which is in the exemplary embodiment over half of the longitudinal distance along bottom surface 332 and in the exemplary embodiment about ⅔ of that distance. Bottom surface 332 from front edge 324 to adjacent transition 251 is spaced upwardly of and thus out of contact with the horizontal upper surfaces of segments 245 and member 233. The front section of bottom plate 320 is thus cantilevered upwardly and forward from adjacent transition 251 to front end 324, which serves as a terminal free end of plate 320.

Top plate 322 has front and back ends or edges 336 and 338 and left and right edges 340 and 342 which together form an outer perimeter of top plate 322 which extends outwardly beyond the outer perimeter of plate 320 in all directions as viewed from below. Front edge 336 is forward of and higher than front edge 324 of bottom plate 320. Rear edge 338 is rearward of and higher than rear edge 326 of bottom plate 320. Left edge 340 extends outwardly to the left beyond left edge 328, and right edge 350 likewise extends outwardly to the right beyond right edge 330. Top plate 322 has bottom and top surfaces 344 and 346 which extend from front edge 336 to back edge 338 and from left edge 340 to right edge 342. As shown in FIG. 9A, top plate 322 and thus its lower and upper surfaces 344 and 346 are straight and horizontal as viewed in a cross section looking forward. As viewed from the side, bottom surface 344 is convexly curved from front edge 336 to back edge 338 and forms an arc of a circle which is concentric about center X and has a radius of curvature which is substantially the same as that of top surface 334 of bottom plate 320. As viewed from the side, top surface 346 is concavely curved from front edge 336 to back edge 338 and forms or lies along an arc of a circle which is also concentric about center X and has a radius of curvature R (FIG. 7) which is substantially the same as that of outer surface 82 of sphere 12 in the inflated resting state of sphere 12. Thus, when seat 12 is inflated and in its resting state, outer surface 82 contacts top surface 346 in a substantially continuous manner from front edge 336 to back edge 338 when seat 12 is seated atop support 238. Top plate 322 is rigidly secured to bottom plate 320 by rivets or any other suitable securing mechanism so that top surface 334 of bottom plate 320 is in its entirety or almost in its entirety in contact with bottom surface 344 of top plate 322. Thus, top surface 344 from front edge 324 to back edge 326 is in substantially continuous contact with bottom surface 344. In addition, top surface 344 is in substantially continuous contact from left edge 328 to right edge 330 with bottom surface 344.

As best illustrated in FIG. 12, the outer perimeter of top plate 322 is curved in a manner so that the outer perimeter has no sharp corners. Thus, front edge 336 faces forward and upwardly and is convexly curved while rear edge 338 faces primarily upwardly and is also convexly curved. Top plate 322 along the left side has three lobes which extend outwardly to the left beyond left edge 328 of bottom plate 320 and also beyond a pair of respective recesses formed between the lobes. Likewise, plate 322 along the right side has three longitudinally spaced lobes which extend outwardly to the right beyond right edge 330 of bottom plate 320 and also beyond a pair of recesses defined respectively between the lobes. The front lobes along the left and right sides of plate 322 each have front convexly curves outer surfaces 348 which face respectively generally to the left and right. Similarly, the intermediate lobes along the left and right of plate 322 have intermediate convexly curved outer surfaces 350 which respectively face generally to the left and right. In addition, the left and right rear lobes of plate 322 have back convexly curved surfaces 352 which respectively face generally to the left and right. A first or front concavely curved surface 354 extends between the respective front and intermediate lobes and communicates smoothly with the respective front and intermediate convexly curves surfaces 348 and 350. Similarly, a second or rear concavely curved surface 356 extends between the respective intermediate and rear lobes and communicates smoothly via a generally straight edge section with the respective intermediate and back convexly curved surfaces 350 and 352.

Referring to FIGS. 7-12, arcuate left and right arms 234A and 234B of the frame include respective left and right rear segments 274A and 274B which extend respectively axially outwardly, upwardly and forward from the respective member 235 of support 232, respective intermediate segments 276A and 276B which extend respectively forward from rear segments 274A and 274B, and front segments 278A and 278B which extend respectively downwardly from the front of intermediate segments 276A and 276B. Front segments 278A and 278B adjacent their lower ends extend axially inwardly toward their rigid connections 243 with segments 245 and frame member 233. More particularly, left and right rear segments 274A and 274B extend axially outwardly from upright 232 and curve forward and slightly upwardly therefrom to transition respectively into left and right intermediate segments 276A and 276B, which curve forward, downwardly and inwardly to transition into left and right front segments 278A and 278B. As viewed from above (FIG. 11), rear segments 274A and 274B curve so that their inner surfaces 285 curve concavely and face generally forward and axially inward toward one another and plane P1 while their outer surfaces 287 curve convexly and face generally rearwardly and axially outward away from one another and plane P1. As viewed from above (FIG. 11) or from the side (FIGS. 7-8) intermediate segments 276 curve so that their inner surfaces 288 curve concavely and face generally axially inward toward one another and plane P1 while their outer surfaces 290 curve convexly and face generally axially outward away from one another and plane P1. As viewed from the side, the bottom downwardly facing surfaces 289 of rear segments 274 and intermediate segments 276 curve concavely, while their top upwardly facing surfaces 291 curve convexly. As viewed from the side, the rearwardly facing back surfaces 293 of front segments 278A and 278B curve concavely while their front forward facing surfaces 295 curve convexly. The lower ends of front segments 278A and 278B curve rearwardly to their respective connections 243 with segments 245 and frame member 233. As viewed from behind (FIG. 9) or from above (FIG. 11), left and right arms 234A and 234B together form a substantially heart-shaped configuration.

Figure 9B:
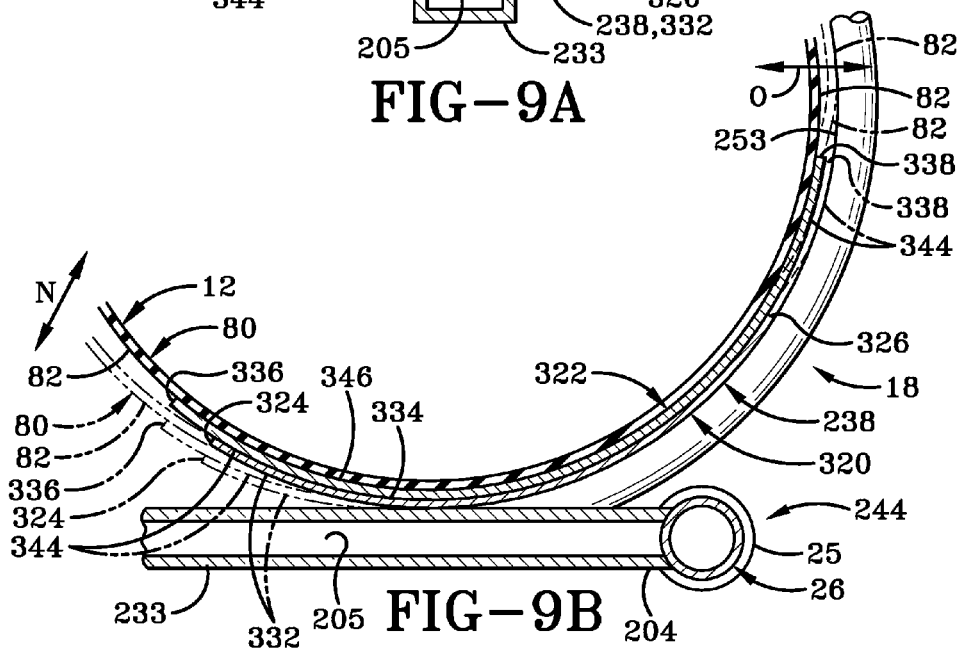
FIG. 9B is a sectional view taken on line 9B-9B of FIG. 12.
Figure 9C:
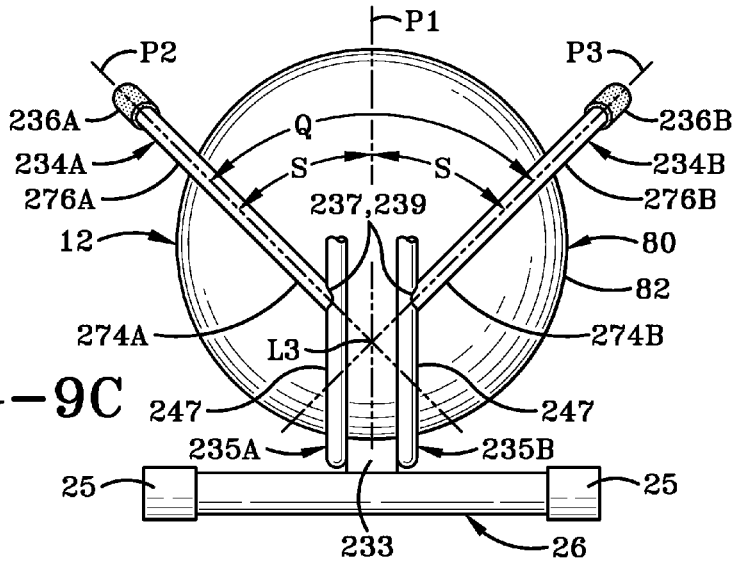
FIG. 9C is a sectional view taken on line 9C-9C of FIG. 8.

In the exemplary embodiment, each arm 234 curves from adjacent its rear end 237 to its front end 241 along an arc of a circle. In addition, as shown in FIG. 9C, left and right arms 234A and 234B lie in their entirety along respective planes P2 and P3 which intersect at a line L3 which lies within plane P1 and is parallel to line L2, (FIG. 8). Line L3 and a horizontal plane such as floor F define therebetween angle K, which thus is the same as the angle formed between line L2 and the horizontal plane. As viewed along line L3 (FIG. 9C), planes P2 and P3 define therebetween an angle Q which in the exemplary embodiment is about 90 degrees and which typically falls within the range of about 70, 75, 80 or 85 degrees to about 95, 100, 105 or 110 degrees. Plane P1 and P2 as viewed along line L3 define therebetween an angle S as do planes P1 and P3. Angle S is thus half the value of angle Q.

Frame 214 adjacent rear end 18 defines a ball receiving space 275 having a top entrance opening 277, a front entrance opening 279, a left rear entrance opening 281 and a right rear entrance opening 283. Ball-receiving or seat-receiving space 275 is generally defined between arms 234A and 234B, forward of upright 232 and above ball support 238. In the exemplary embodiment, top surface 346 of top plate 322 defines the bottom of space 275, the front surface 253 of segments 247 of members 235 define the back of space 275 and portions of intermediate segments 276 and/or front segments 278 of arms 234 typically define the left and right sides of space 275. Top entrance opening 277 is defined between intermediate segments 276A and 276B while front entrance opening 279 is defined between front segments 278A and 278B. Left rear entrance opening 281 is defined generally between left arm 234A, left edge 340 of top plate 322 and the upper portion of segment 247 of left support member 253A extending upwardly from back edge 338 of top plate 322 to connection 239. Similarly, right rear entrance opening 283 is defined generally between right arm 234B, right edge 342 of top plate 322 and the upper portion of segment 247 of right support member 253B extending upwardly from back edge 338 of top plate 322 to connection 239. In the exemplary embodiment, each of the entrance openings 277, 279, 281 and 283 is completely or substantially free of any components extending between the various structures which define said entrance openings. In the exemplary embodiment, machine 200 is free of or substantially free of components extending into space 275 other than inflated seat 12.

Figure 10:
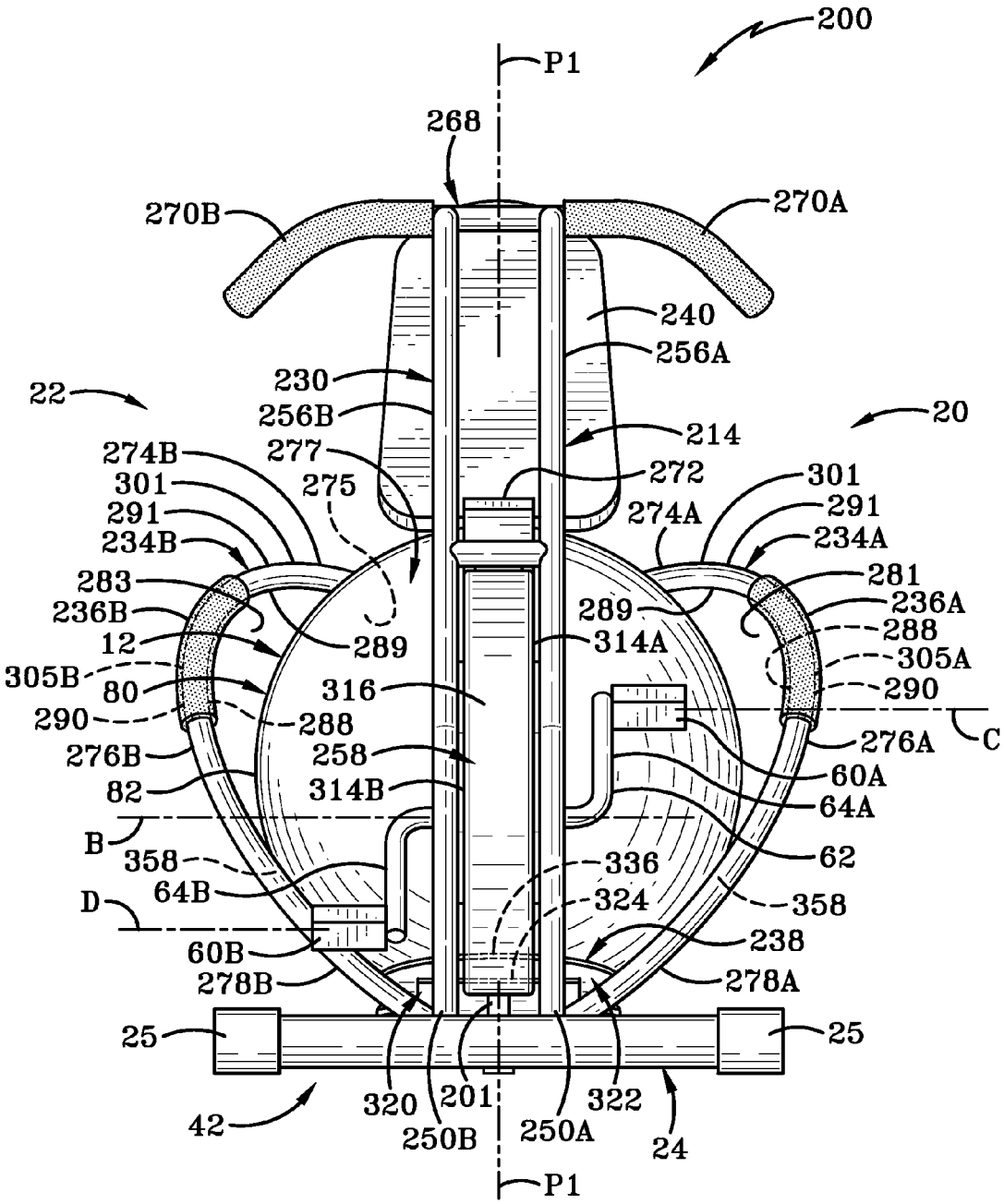
FIG. 10 is a front end elevational view of the second embodiment.
Figure 11:
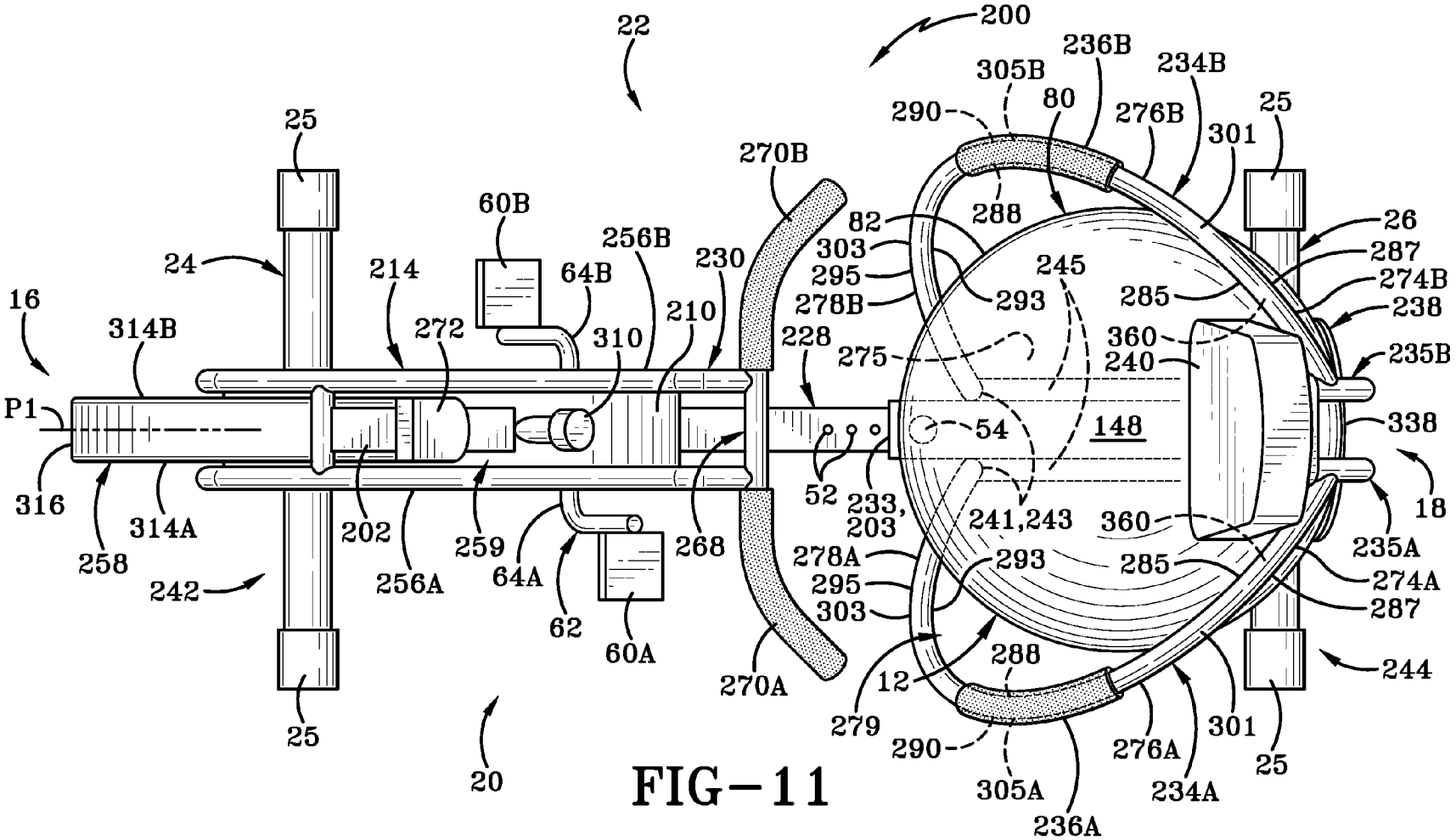
FIG. 11 is a top plan view of the second embodiment.

When inflated seat 12 is mounted at rest on frame 214, the bottom of outer surface 82 is seated on top surface 346 of plate 322, as are portions of outer surface 82 extending forward and upward therefrom to front edge 336 and extending rearward and upward therefrom to back edge 338. A rearward portion of outer surface 82 above back edge 338 is adjacent and spaced forward out of contact with front surface 253 of seat support 232. Left and right forward lower portions of outer surface 82 in the forward half and lower half of the spherical seat 12 are closely adjacent or abut the lower portions of front segments 278A and 278B at contact points 358 (FIGS. 7, 8, 10). In addition, left and right rearward upper portions of outer surface 82 in the rearward half and upper half of seat 12 are closely adjacent or abut segments 274A and 274B respectively at contact points 360 (FIGS. 7-9). Typically, intermediate segments 276A and 276B are spaced outwardly from seat 12 and are thus not in contact with outer surface 82 of seat 12 at rest or when compressed when a user is seated thereon. Also typically, the above noted places of contact or interface between outer surface 82 and the various surfaces of frame 214 are the only places of contact between the ball and frame when the inflated ball is at rest whereby the remainder of outer surface 82 is out of contact with frame 214. The portions of the frame which extend upwardly and contact the outer surface of seat 12 substantially prevent it from rolling atop plate 238. Seat 12 is also substantially non-rotatably mounted within space 275 due to frictional engagement (or securing devices if used) between seat 12 and frame 214.

When sphere 12 is inflated and in its resting state, frame 214 is configured to receive seat 12 within receiving space 275 through top entrance opening 277 and typically through a portion of front entrance opening 279, which together form an entrance opening which extends generally upwardly and forward along intermediate segments 276 and front segments 278. Seat 12 is thus inserted downwardly and rearwardly through entrance openings 277 and 279 until it is seated atop ball support 238. This insertion of sphere 12 into space 275 may or may not involve compression as discussed above regarding bike 10.

Generally, left and right rear entrance openings 281 and 283 are configured so that at least one dimension of the respective entrance opening is sufficiently less than the diameter of the inflated ball in order to prevent it from moving through the respective entrance opening during use of machine 200. When inflated ball seat 12 is positioned at a state of rest in receiving space 275, side grip handles 236 and most of segments 276 are at a height which is a little lower than the top of ball 12 although they may be slightly higher or at the same height. Handles 236 and intermediate segments 276 are typically substantially above the height of the midway point between the top and bottom of the ball, (the center X of the ball) and typically at least ¾ of the height of the ball. The uppermost points 301 of each arm 234 are likewise at a height which is about the same as that described above with regard to handles 236. In addition, the uppermost points of 301 are in the exemplary embodiment positioned along the rear half of sphere 12. In addition, uppermost points 301 are generally adjacent and axially outward of the bottom of seat back 240. The forward most point 303 of each front segment 278 is typically spaced longitudinally forward from the seat support or back end 18 about the same distance as the front most portion of ball 12.

Referring now to FIGS. 7, 8 and 10-12, housing 258 includes left and right vertical panels 314A and 314B. Housing 258 further includes a perimeter wall 316 which is connected to the respective outer perimeters of vertical panels 314 whereby panels 314 and perimeter wall 316 define therewithin an interior chamber 317 of housing 258. A generally flat and vertically oriented flywheel 318 is disposed within interior chamber 317 and rotatable about axis J, which is parallel to axes B, C and D and offset forward thereof. A driven sprocket or pulley 313 secured to one side thereof with its outer perimeter concentric about axis J. A resistance mechanism 120 is provided within the interior chamber of housing 259 and is controlled by resistance control 310 in order to allow the user to control the amount of resistance on flywheel 318 and thus to the pedaling motion of the user. The various resistance mechanisms described with regard to bike 10 may be used. A drive sprocket or pulley 311 is mounted within interior chamber of housing 259 with an outer perimeter which is concentric about and rotates about axis B. A drive chain or belt 312 is looped around the outer perimeters of pulleys 311 and 313 so that rotation of drive pulley 311 drives the rotation of driven pulley 313 and fly wheel 318 via belt 312. Holes 66A and 66B are formed respectively in left and right vertical panels 208A and 208B such that crank 62 extends axially outwardly from drive pulley 311 therethrough. Thus, the user places his feet on pedals 60 to force the pedals to rotate about axis B and the fly wheel 318 to rotate about axis J via the above described drive chain.

Generally, bike 200 operates in the same manner as bike 10 although bike 200 in the exemplary embodiment does not include the air compressor or sensor which was used with bike 10 to adjust the degree of inflation of ball 12. Thus, the user typically rests his back against seat back 240 while seated on inflatable seat 12 and pedaling the stationary bike. The user may hold handles 270 or 236 or may choose not to hold on to any handles, as described with regard to bike 10. The manner in which a person will use bike 200 is essentially the same as discussed with regard to bike 10 and thus is not described in any greater detail here.

As noted with regard to bike 10, the movement of the inflated seat 12 from its resting state to its compressed state (analogous to FIG. 6 and shown in dashed lines in FIGS. 9A and 9B) in response to the downward force of the user seated thereon increases the surface area of contact between outer surface 82 and frame 214. More particularly, FIG. 9A illustrates in solid lines that outer surface 82 at the bottom of the sphere 12 contacts only a portion of top surface 346 of top plate 322 generally midway between edges 340 and 342 in the resting state whereas the surface area of contact between outer surface 82 and top surface 346 of plate 322 in the compressed position (dashed lines), a substantially greater portion and typically the entire top surface 346 is in contact with outer surface 82. The movement of bladder wall 80 adjacent left and right edges 340 and 342 of top plate 322 is shown at Arrows M. In addition, FIG. 9B illustrates that outer surface 82 above back edge 338 of top plate 322 moves from a position shown in solid lines out of contact with front surfaces 253 of segments 247 to a compressed position shown in dashed lines in contact with surfaces 253. In addition, movement from the resting state to the compressed state either brings outer surface 82 into contact with points of contact 358 (FIG. 10) and 360 (FIG. 9) or simply increases the amount of contact between outer surface 82 and arms 234 around said points of contact.

FIG. 9B also illustrates the flexing movement of ball support 238 at arrows N and O. More particularly, when the user sits atop ball 12 and thus causes ball 12 to move from its resting state to its compressed state, the downward and/or forward force on ball 12 is transferred in part to top plate 322 and bottom plate 320 adjacent the free front ends 326 and 324 thereof. This downward force causes plates 320 and 322 to flex downwardly in a pivoting manner about a portion of plates 320 and 322 adjacent transition 251 from the resting state or position shown in solid lines to the compressed or downwardly flexed position shown in dashed lines. Once the user gets off of ball 12 and thus removes the downward force, the spring biased characteristic of bottom plate 320 and resilient nature of top plate 322 cause the front ends of plates 320 and 322 to flex pivotally back upward from the compressed or flexed state to the resting state. This flexing movement is illustrated by arrow N in FIG. 9B. In addition, the downward pressure on the top of seat 12 applies a radially outward force along bladder wall 80 which is transferred in part rearwardly against top plate 322 adjacent back edge 338 such that the upper rear portion of top plate 322 flexes pivotally adjacent back edge 322 of bottom plate 320 from a position shown in solid lines spaced forward of surfaces 253 to a flexed position shown in dashed lines which is closer to or in contact with surfaces 253.

It will be evident to one skilled in the art that various alterations may be made which are within the scope of the present invention. For instance, the shape of the inflatable seat may vary beyond those illustrated in the figures. In addition, the mounting structures used to secure the inflatable seat to the frame may vary beyond those shown in the figures. While the seat of the invention has been described above as being inflated with air or another gas, it may also be a liquid filled seat which also allows for a substantial amount of flexibility of the bladder during operation. A gas filled bladder is typically preferred inasmuch as it reduces the amount of weight while also minimizing the resistance to the flexible movement of the bladder compared to a liquid filled bladder. In addition, other seats may be configured to provide the substantial amount of movement required to provide a workout of the user's core muscles during operation. For example, a gel seat or another seat formed of certain types of semi-solid materials may be configured to provide the suitable type of movement to provide this core workout. Any of the inflatable seats may be used with or without a valve for controlling the inflation. An alternate pneumatic system may be provided which is not powered by the user, such as an electrically powered compressor which may or may not include a tank of compressed air. In addition, the cardiovascular and core workout provided by the bike is achieved whether or not the pneumatic system for adjusting the height of the seating surface is used. While the sensor described herein uses a laser beam for determining the height of the seating surface of the inflated seat, other known distance sensors may be used. An alternate height adjustment for the seat may also be used, such as a standard telescoping pole with a securing mechanism to secure the pole, mounting structure of the seat and inflated bladder at a desired height. In addition, the pedaling mechanism may be altered to one other than the illustrated pedaling concept in which the axles of pedals 60 move about a circular path around axis B while pedals 60 simultaneously pivot about their respective pedal axles. For instance, the bike may be configured with pedals that move along an elliptical path with or without rotation of the individual pedals about respective axles. In addition, the bike may be configured such that the pedals will move back and forth along a strictly linear path, for instance, more like a "stepper" machine. Each of these options provides an oscillating movement of the user's feet and pedals during operation. In addition, the set of pedals in the exemplary embodiment is secured to fly wheel 118. Furthermore, while the stationary bike of the present invention is shown as a recumbent type bike, it is also contemplated that the present invention may be configured more as an upright stationary bike. The bike may also be configured with various structures convenient to the user such as a key holder, a cup holder or bottle holder, a towel rack or other type of holder for towels, and so forth. Other modifications within the scope of the present invention will be evident to one skilled in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals;

a seat back which extends upwardly of and adjacent the inflatable seat and is adapted for resting a user's back against while the user is seated on the inflatable seat;

a top and a bottom of the frame;

a seat back support of the frame which extends upwardly behind the inflatable seat;

left and right elongated arms which extend respectively to the left and right of the inflatable seat, wherein the left arm is formed of a single left arm tube and the right arm is formed of a single right arm tube;

a first end of the left arm tube connected to the seat back support at a first connection;

a second opposed end of the left arm tube connected to the frame adjacent the bottom at a second connection forward of and lower than the first connection;

a first end of the right arm tube connected to the seat back support at a third connection; and a second opposed end of the right arm tube connected to the frame adjacent the bottom at a fourth connection forward of and lower than the third connection; and wherein the seat back is mounted on the seat back support.

2. The machine of claim 1 wherein a vertical central longitudinally extending plane passes through a center of the exercise machine; the left arm tube forms an arc of a circle which extends from the first end of the left arm tube to the second end of the left arm tube so that the left arm tube in its entirety lies along a left plane which angles upwardly and to the left from the vertical central longitudinally extending plane; and the right arm tube forms an arc of a circle which extends from the first end of the right arm tube to the second end of the right arm tube so that the right arm tube in its entirety lies along a right plane which angles upwardly and to the right from the vertical central longitudinally extending plane.

3. The machine of claim 2 wherein the left and right planes intersect at a line which angles upwardly and rearwardly from adjacent the second and fourth connections.

4. The machine of claim 1 further comprising a front section of the frame; a rear section of the frame; a securing mechanism for detachably mounting the rear section on the front section; and wherein the set of pedals are mounted on the front section; the inflatable seat is mounted on the rear section; and the rear section and inflatable seat together serve as a seating assembly when the rear section is detached from the front section.

5. The machine of claim 4 wherein the rear section of the frame has front and rear ends; and further comprising a foot which is secured to and extends downwardly from the rear section adjacent the front end thereof and is formed of a substantially non-scratching material which is sufficiently soft so as to minimize scratching of a floor when the rear section is seated on the floor.

6. The machine of claim 1 wherein the inflatable seat has a seating surface which is height adjustable in response to a degree of compression of the inflatable seat; and further comprising a sensor operationally connected to the inflatable seat for sensing the height of the seating surface.

7. The machine of claim 1 further comprising an air compressor in fluid communication with the inflatable seat.

8. The machine of claim 1 further comprising a seat support rigidly secured to the frame and having a left edge, a right edge and an upwardly facing top surface extending from the left edge to the right edge;

wherein the inflatable seat has an outer surface which is convexly curved and has a bottom;

adjacent the bottom of the inflatable seat, the upwardly facing top surface is straight and horizontal from the left edge to the right edge as viewed looking forward; and the bottom of the convexly curved outer surface of the inflatable seat is seated on the upwardly facing top surface of the seat support.

9. The machine of claim 1 wherein the left and right arms comprise respective rear segments, intermediate segments respectively connected to and extending forward from the rear segments, and front segments respectively connected to and extending downwardly from the intermediate segments;

the inflatable seat has an outer surface;

the intermediate segments are spaced outwardly from the inflatable seat respectively to the left and right of the inflatable seat such that the intermediate segments are not in contact with the outer surface of the inflatable seat (a) when the inflatable seat is at rest and (b) when the inflatable seat is compressed when a user is seated thereon.

10. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals;

wherein the frame comprises a rigid support member having an arcuate back segment which curves upwardly and rearwardly below and behind the inflatable seat;

further comprising a seat support rigidly secured to the arcuate back segment and having an upwardly facing top surface which is concavely curved as viewed from the side of the inflatable seat; and wherein the inflatable seat has an outer surface which is convexly curved as viewed from the side of the inflatable seat and which has a bottom; and the convexly curved outer surface of the inflatable seat is seated on the concavely curved top surface of the seat support so that a portion of the outer surface of the inflatable seat which extends forward and upward from the bottom of the outer surface of the inflatable seat is in contact with the concavely curved top surface of the seat support.

11. The machine of claim 10 wherein the concavely curved top surface is straight and horizontal as viewed in a cross section of the seat support looking forward; and the cross section is adjacent the bottom of the inflatable seat.

12. The machine of claim 10 wherein a vertical central longitudinally extending plane passes through a center of the exercise machine; the convexly curved outer surface of the inflatable seat has a radius of curvature; the concavely curved top surface of the seat support has a radius of curvature which is about the same as that of the convexly curved outer surface; the seat support has a front edge forward of the bottom of the inflatable seat and a back edge rearward of the bottom of the inflatable seat; each of the front and back edges is higher than the bottom of the outer surface; the concavely curved top surface is concavely curved from the front edge to the back edge; and the outer surface contacts the concavely curved top surface in a substantially continuous manner from the front edge to the back edge along an intersection of the vertical central longitudinally extending plane and the concavely curved top surface.

13. The machine of claim 10 wherein the seat support comprises a back section which is rigidly secured to the arcuate back segment and a front section which is cantilevered upwardly and forward from the back section to a terminal free front end; and the front section of the seat support flexes downwardly in response to a downward force on the inflatable seat.

14. The machine of claim 10 wherein said rigid support member comprises an upwardly facing top surface which is concavely curved as viewed from the side of the inflatable seat; and wherein the seat support has a downwardly facing bottom surface which is convexly curved as viewed from the side of the inflatable seat; and the seat support is secured to the rigid support member with the convexly curved downwardly facing bottom surface seated on the concavely curved upwardly facing top surface to form a mating engagement therebetween.

15. The machine of claim 10 wherein the seat support comprises a bottom plate which is formed of a spring metal and a top plate which is formed of a resilient plastic and defines the concavely curved top surface of the seat support; the bottom plate has an upwardly facing top surface which is concavely curved as viewed from the side of the inflatable seat; and the top plate is seated atop and rigidly secured to the bottom plate.

16. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals; and a seat support rigidly secured to the frame and having an upwardly facing top surface which is concavely curved as viewed from the side of the inflatable seat; and wherein the inflatable seat has an outer surface which is convexly curved as viewed from the side of the inflatable seat and which has a bottom;

the convexly curved outer surface of the inflatable seat is seated on the concavely curved top surface of the seat support so that a portion of the outer surface of the inflatable seat which extends forward and upward from the bottom of the outer surface of the inflatable seat is in contact with the concavely curved top surface of the seat support;

the seat support comprises a back section which is rigidly secured to the frame and a front section which is cantilevered upwardly and forward from the back section to a terminal free front end; and the front section flexes downwardly in response to a downward force on the inflatable seat.

17. The machine of claim 16 wherein the concavely curved top surface is straight and horizontal as viewed in a cross section looking forward; and the cross section is adjacent the bottom of the inflatable seat.

18. The machine of claim 16 further comprising a seat back which extends upwardly of and adjacent the inflatable seat and is adapted for resting a user's back against while the user is seated on the inflatable seat.

19. The machine of claim 16 further comprising left and right arms secured to the frame and extending respectively to the left and right of the inflatable seat.

20. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals; and left and right arcuate arms secured to the frame and extending respectively to the left and right of the inflatable seat;

wherein the left and right arms comprise respective rear segments, intermediate segments respectively connected to and extending forward from the rear segments, and front segments respectively connected to and extending downwardly from the intermediate segments;

the intermediate segments have respective inner surfaces which face generally toward one another and are concavely curved as viewed from above the inflatable seat;

the intermediate segments have respective downwardly facing bottom surfaces which are concavely curved as viewed from the side of the inflatable seat;

a vertical central longitudinally extending plane passes through a center of the exercise machine;

the frame has a top and a bottom;

the frame includes a bottom longitudinal frame member which is longitudinally elongated and extends horizontally along the bottom of the frame below the inflatable seat adjacent the vertical central longitudinally extending plane;

the front segment of the left arm extends to the right from the intermediate segment of the left arm to a front end of the left arm which is secured to the bottom longitudinal frame member; and the front segment of the right arm extends to the left from the intermediate segment of the right arm to a front end of the right arm which is secured to the bottom longitudinal frame member; and further comprising left and right handles on the respective intermediate segments.

21. The machine of claim 20 wherein the front segments have respective rearwardly facing back surfaces which are concavely curved as viewed from the side of the inflatable seat.

22. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals;

a seat back which extends upwardly of and adjacent the inflatable seat and is adapted for resting a user's back against while the user is seated on the inflatable seat;

wherein the frame comprises a rigid elongated support member which extends upwardly behind the inflatable seat; and the seat back is secured to the rigid elongated support member;

further comprising a seat support on which the inflatable seat is seated;

wherein the seat support has an upwardly facing top surface which is concavely curved as viewed from the side of the inflatable seat;

the seat support comprises a back section which is rigidly secured to the elongated support member and a front section which is cantilevered upwardly and forward from the back section to a terminal free front end;

the inflatable seat is in contact with the front section of the seat support; and the front section of the seat support flexes downwardly in response to a downward force on the inflatable seat.

23. The machine of claim 22 wherein the seat support comprises a plate a portion of which flexes downwardly in response to the downward force.

24. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals; and a seat support rigidly secured to the frame and having an upwardly facing top surface which is concavely curved as viewed from the side of the inflatable seat; and wherein the inflatable seat has an outer surface which is convexly curved as viewed from the side of the inflatable seat and which has a bottom; and the convexly curved outer surface of the inflatable seat is seated on the concavely curved top surface of the seat support so that a portion of the outer surface of the inflatable seat which extends forward and upward from the bottom of the outer surface of the inflatable seat is in contact with the concavely curved top surface of the seat support;

further comprising left and right arms secured to the frame and extending respectively to the left and right of the inflatable seat;

wherein a first end of the left arm is connected to a seat back support at a first connection;

a second opposed end of the left arm is connected to the frame adjacent the bottom at a second connection forward of and lower than the first connection;

a first end of the right arm is connected to the seat back support at a third connection; and a second opposed end of the right arm is connected to the frame adjacent the bottom at a fourth connection forward of and lower than the third connection.

25. The machine of claim 24 wherein the seat support comprises a back section which is rigidly secured to the frame and a front section which is cantilevered upwardly and forward from the back section to a terminal free front end; and the front section flexes downwardly in response to a downward force on the inflatable seat.

26. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals;

a seat back which extends upwardly of and adjacent the inflatable seat and is adapted for resting a user's back against while the user is seated on the inflatable seat;

a top and a bottom of the frame;

a seat back support of the frame which extends upwardly behind the inflatable seat;

left and right arcuate arms secured to the frame and extending respectively to the left and right of the inflatable seat; and wherein a vertical central longitudinally extending plane passes through a center of the exercise machine;

each of the left and right arms has first and second opposed ends;

the first end of the left arm is secured to the seat back support at a first connection;

the second end of the left arm is secured to the frame adjacent the bottom of the frame at a second connection which is forward of and lower than the first connection;

the first end of the right arm is secured to the seat back support at a third connection;

the second end of the right arm is secured to the frame adjacent the bottom of the frame at a fourth connection which is forward of and lower than the third connection;

the left arm forms an arc of a circle which extends from the first end of the left arm to the second end of the left arm;

the right arm forms an arc of a circle which extends from the first end of the right arm to the second end of the right arm;

the left arm in its entirety lies along a left plane which angles upwardly and to the left from the vertical central longitudinally extending plane; and the right arm in its entirety lies along a right plane which angles upwardly and to the right from the vertical central longitudinally extending plane.

27. An exercise machine comprising:

a frame having a front and a rear defining therebetween a longitudinal direction and left and right sides defining therebetween an axial direction;

a set of pedals movably mounted on the frame;

a seat-receiving space defined by the frame rearwardly from the set of pedals;

an inflatable seat within the seat-receiving space and adapted for a user of the machine to sit on while the user's feet are on the pedals;

a seat back which extends upwardly of and adjacent the inflatable seat and is adapted for resting a user's back against while the user is seated on the inflatable seat;

wherein a vertical central longitudinally extending plane passes through a center of the exercise machine;

further comprising at least one rigid support member which in its entirety lies adjacent the vertical central longitudinally extending plane and includes a front lower horizontal longitudinal segment positioned under the inflatable seat and an arcuate back segment which curves upwardly and rearwardly behind the inflatable seat from a back end of the front segment;

left and right arcuate arms secured to the frame and extending respectively to the left and right of the inflatable seat; and wherein the left and right arms each have rear and forward ends;

the left arm curves continuously from adjacent the rear end of the left arm to adjacent the forward end of the left arm;

the rear end of the left arm is secured to the at least one rigid support member at a first connection behind the inflatable seat;

the forward end of the left arm is secured to the at least one rigid support member at a second connection which is below the inflatable seat, is adjacent the front lower horizontal longitudinal segment and is forward of and lower than the first connection;

the right arm curves continuously from adjacent the rear end of the right arm to adjacent the forward end of the right arm;

the rear end of the right arm is secured to the at least one rigid support member at a third connection behind the inflatable seat;

the forward end of the right arm is secured to the at least one rigid support member at a fourth connection which is below the inflatable seat, is adjacent the front lower horizontal longitudinal segment and is forward of and lower than the third connection.

* * * * *